US006540175B1

(12) United States Patent
Mayersak et al.

(10) Patent No.: US 6,540,175 B1
(45) Date of Patent: Apr. 1, 2003

(54) SYSTEM FOR CLEARING BURIED AND SURFACE MINES

(75) Inventors: Joseph R. Mayersak, Ashburn, VA (US); Lance H. Benedict, McLean, VA (US); Robert M. Krass, Sterling, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 36 days.

(21) Appl. No.: 09/997,654

(22) Filed: Dec. 3, 2001

(51) Int. Cl.[7] ..... F41G 7/00; F42B 15/01; F42B 12/60

(52) U.S. Cl. ..... 244/3.15; 89/1.13; 244/3.1; 244/3.23

(58) Field of Search ..... 244/3.1, 3.15, 244/3.16–3.3; 89/1.13; 102/323

(56) References Cited

U.S. PATENT DOCUMENTS

| | | | | |
|---|---|---|---|---|
| 582,982 A | | 5/1897 | Cope | |
| 1,181,278 A | | 5/1916 | Wiley | |
| 2,445,311 A | | 6/1948 | Cooke et al. | |
| 2,476,187 A | | 6/1949 | Short | |
| 3,013,490 A | | 12/1961 | Flatau | |
| 3,111,086 A | | 11/1963 | Alperstein | |
| 3,254,996 A | | 6/1966 | MacDonald | |
| 3,724,319 A | * | 4/1973 | Zabelka et al. | 89/1.13 |
| 5,016,533 A | | 5/1991 | Borngen | |
| 5,456,429 A | | 10/1995 | Hayersak | |
| 5,507,452 A | | 4/1996 | Hayersak | |
| 5,524,524 A | * | 6/1996 | Richards et al. | 89/1.13 |
| 5,657,947 A | | 8/1997 | Hayersak | |
| 5,686,686 A | * | 11/1997 | Woodall et al. | 89/1.13 |
| 5,866,838 A | | 2/1999 | Hayersak | |
| 6,155,155 A | * | 12/2000 | Moshier | 89/1.13 |
| 6,202,531 B1 | * | 3/2001 | Comeyne | 89/1.13 |
| 6,254,031 B1 | | 7/2001 | Hayersak | |
| 6,354,222 B1 | * | 3/2002 | Becker et al. | 102/323 |

FOREIGN PATENT DOCUMENTS

| | | | | |
|---|---|---|---|---|
| EP | 0516007 A2 | * | 12/1992 | F42B/33/06 |
| EP | 0916921 A1 | * | 5/1999 | F42B/12/36 |
| FR | 2775769 A1 | * | 9/1999 | F41F/1/00 |
| FR | 2775770 A1 | * | 9/1999 | F42B/30/08 |
| FR | 2779514 A1 | * | 12/1999 | F42B/12/14 |
| GB | 2321880 A | * | 8/1998 | F41H/11/16 |

* cited by examiner

*Primary Examiner*—Bernarr E. Gregory
(74) *Attorney, Agent, or Firm*—Charles E. Temko

(57) ABSTRACT

A method for deflagrating/detonating anti-tank and anti-vehicle land mines, beach zone mines, and surf zone mines located in mine belts or individually using delayed active ignition high temperature incendiary flechettes or darts.

13 Claims, 25 Drawing Sheets

SYSTEM FOR CLEARING BURIED AND SURFACE MINES

BACKGROUND OF THE INVENTION

This invention relates to clearing by detonating or deflagrating anti-tank and anti-vehicle land mines located on the beach, or beach zone mines; located in the water near the surf line; or surf zone mines configured in mine corridors consisting of several mines or mine belts or individually. The invention allows the rapid clearing of large numbers of mines in an extremely short time or the clearing of mines "in stride" by amphibious forces or armored task force elements.

The ability to clear beach zone and surf zone mines in support of amphibious operations allowing landing craft to move ashore to deposit combat forces is an offensive capability having high priority. The projection of power from the sea requires that mines be cleared in the beach zone and surf zone with a high probability of success in multiple landing zones in an extremely short time. Further, the ability to clear land mines by the maneuver elements or armored task forces to prevent the enemy from creating kill zones and channeling friendly forces is a combat capability having high priority for ground forces. The clearing of anti-armor and anti-vehicle mines in a short time, in stride, with a high probability of success is a critically required capability.

While the clearing of land mines is a capability which both amphibious forces and armored task forces currently can accomplish, they cannot accomplish the task without a significant investment in mine clearing equipment, as well as in the time necessary to clear the mines.

DISCUSSION OF PRIOR ART

Mine clearing concepts currently involve, in the case of armored task forces, vehicle-mounted systems such as mine flails and rollers. These systems are designed to cause the mines to detonate by activating the pressure sensitive fuses on the mines. Mine clearing capability for amphibious forces employs netted systems launched from landing craft or air-cushioned landing craft vehicles where the nets are deployed using rocket propelled deployment systems to overlay the beach area and detonate the mines due to over pressure of shaped charges attached on the net.

Aircraft-delivered systems using fixed wing and rotary wing aircraft have included the use of fuel-air explosives and conventional powder gun projectiles. Fuel-air explosives mixed fuel with the air to obtain a proper air-fuel mixture ratio and detonate the mixture using a timed detonator system to over pressure the area over a minefield and cause the mines to detonate. Gun systems fire 50 caliber gun projectiles designed to detonate mines on impact and incorporating the ability to penetrate both soil and water to allow beach zone and surf zone mines to be cleared.

The use of metal detectors with ground troops to clear mines by hand has been a major approach in the prior art. This approach, because of the time consumed in clearing mines and because of the design of mines with no metal elements, is not in as wide a use as before.

Prior art has focused on fixed wing and rotary wing aircraft vehicle delivered and air-cushioned landing craft and landing craft delivered mine clearing systems. The design approach used by these concepts is one which focuses on exercising the mine fuse system causing the fuse to operate and detonate the mine or have focused on destroying the fuse and fuse well to preclude operation of the mine and render the mine safe. These approaches have not focused on attacking the mine TNT, CompB, or other explosive fills in a concept which deflagrates the mine by causing the fill to go low order as the defeat mechanism. An alternate defeat mechanism would be attacking the mine fill to cause the mine fill to detonate. The reason that these approaches have not been employed is that it is difficult to deflagrate/detonate TNT fills or other fills since they require on the order of 30 kilobars of overpressure to initiate the deflagration/detonation. This usually requires that the mine fuse and fuse well use a detonator and booster charge to apply sufficient pressure to the TNT, or alternate fill, to cause it to detonate. The current invention specifically is designed to cause the mine fill to detonate/deflagrate and allows the clearing of minefields and mine belts in very short time.

SUMMARY OF INVENTION

Briefly stated, the invention allows a large number of anti-vehicle or antitank mines to be cleared in extremely short time in a concept designed to attack the mine TNT, CompB, or alternate explosive fill and causing it to deflagrate/detonate.

The invention involves a system concept over clearing minefields in stride. The invention involves the delivery, typically, of dispensers containing small munitions. In the air-delivered concept, these munitions are typically six inches in diameter and forty to sixty inches long. The munitions include a guidance section, jet reaction control system, rocket motor, and flechette or dart dispensing system containing high temperature incendiary flechettes or darts. The dart dispensing system would contain and have the ability to dispense 1,000, 0.35-inch diameter, 4-inch long flechettes or darts packaged in five rows of 200 darts each. The air-delivered concept would utilize GPS-guided or GPS-updated inertial guided munitions incorporating jet reaction control or canard and tail control to maneuver the munitions to their aimpoint. While the concept is described as an air-delivered approach, artillery concepts using 5-inch and 155 mm gun projectiles or missile artillery using surface-to-surface guided multiple launch rocket systems or tactical missiles could be employed.

In the air delivery concept, used as an example, multiple tactical munitions dispensers will be delivered by a fixed wing aircraft. Subsequent to delivery of the tactical munitions dispenser, the dispensers would be opened and, typically, five mine clearing munitions would be ejected from each tactical munitions dispenser. Each munition would then guide to an aimpoint utilizing GPS information and maneuver, utilizing the jet reaction control system taught by Mayersak, U.S. Pat. No. 5,456,429, to position the munition in a vertical descent over the minefield utilizing the inverse guidance law taught by Mayersak, U.S. Pat. No. 6,254,031. The jet reaction control system, operating typically at a 25 millisecond rate, would change the force states to control the angle of slide slip in such a way to position the munition over the target in a vertical descent at an aimpoint. At this point, the rocket motor would be ignited. A fluted rocket nozzle would spin the munition to 60 cycle-per-second and accelerate the munition to 2,500 feet-per-second. At this point, a dispensing system would open the anti-mine munition and the 1,000 darts contained in the munition would be dispensed due to high-speed rotation and centrifugal force in such a way that a uniform pattern of darts would impact the ground. The spacing between darts would be designed such that one or more darts would impact a mine located in the dart pattern and, in the case where several mines would be in the pattern, all would be hit one or more times.

The flechettes or darts delivered by the mine clearing munition would be capable of penetrating the soil or water in a cavitating generating mode utilizing a small tungsten nose pin to cause the high velocity dart to create a cavity. In the case of water penetration, the hydrodynamic cavitation or supercavitating penetrating concept, allows the anti-mine flechette or dart to penetrate with just the nose of the dart in contact with the water while the dart creates an envelope around it or a cavity to allow low-drag penetration in the water. The cavitation effect or supercavitating penetration is well known and documented in the literature. The anti-mine dart tungsten nose and high velocity is also designed, however, to create a cavity while penetrating dirt in a terradynamic cavitation concept to allow the dart to penetrate to and defeat mines in soil up to two feet. The terradynamic and hydrodynamic cavity effect allows the dart to incorporate a delayed active ignition system employing an active element such as a primer or blank cartridge to ignite a high temperature incendiary fill contained in the dart. The delayed active ignition system allows the ignition of high temperature fill to occur when the dart impacts the plastic case or steel case of the surface or buried mine and not initiate when the dart impacts the soil or water because of the cavity effect. The active ignition system ignites the high temperature incendiary fill contained in the dart. The fill is a form of specialized rocket propellant such as a metalized ammonium perchlorate or metalized potassium perchlorate having an ignition time on the order of 50 microseconds. As the dart penetrates into the mine, the dart locally fractures the mine TNT or high explosive fill and propagates cracks into the rest of the fill. The fracturing mechanism is the expanding head of the dart due to the delayed active ignition system and kinetic energy of the dart as it penetrates into the mine. The high temperature incendiary fill of the dart ignited by the active ignition system ignites the mine TNT or high explosive fill locally which propagates to a deflagration or detonation of the mine destroying the mine.

Since a large number of anti-mine munitions can be delivered by fixed wing aircraft, the clearing of mines can be accomplished essentially in stride in a short time.

DETAILED DESCRIPTION OF THE DISCLOSED EMBODIMENTS

The concept to clear large numbers of buried and surface mines in a short time, in overview, includes the system and operation of the system, dart fill and cavity generating effects for the high temperature incendiary countermine dart and the dart ignition system.

System Concept

Figure 1:
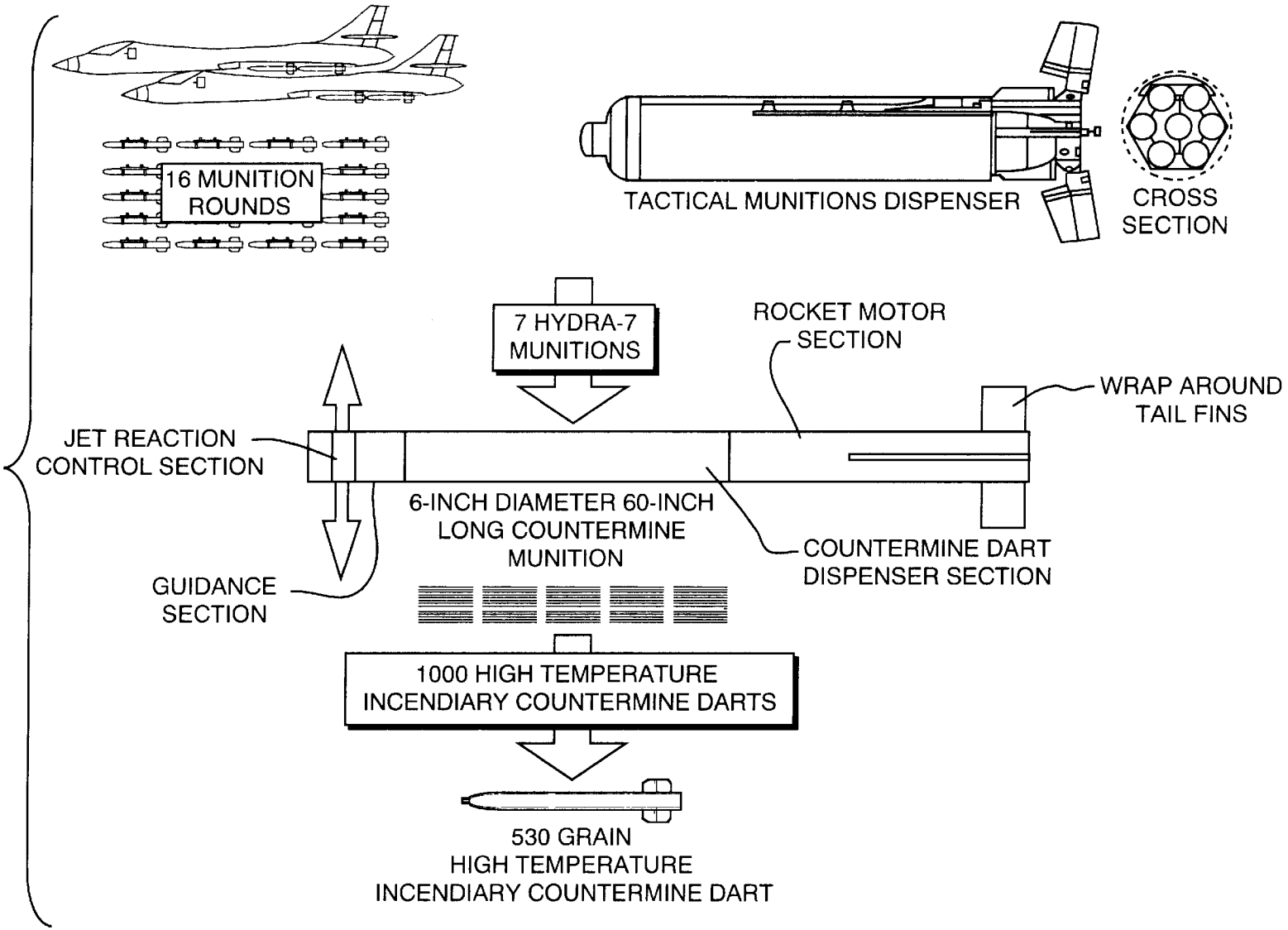
FIG. 1 illustrates the countermine system components of an embodiment of the invention, including dispenser system, countermine munition, and countermine high temperature incendiary flechettes or darts.

The system concept, using the air-delivered system as an example, typically comprises a tactical munitions dispenser packaging five 6-inch diameter, 60-inch long countermine munitions (FIG. 1). Each countermine munition contains 1,000 high temperature incendiary countermine flechettes or darts contained in a dispensing system located in the mid-body of the countermine munition. The countermine munition incorporates a GPS receiver and antenna system to allow signals from the GPS satellite constellation to be employed by the guidance logic of the countermine munition to determine its position relative to the GPS coordinates of the aimpoint over the minefield at which the rocket motor, located in the aft of the munition, is initiated to deliver the countermine darts. The countermine munitions uses the jet reaction control system taught by Mayersak, U.S. Pat. No. 6,254,031 to effect maneuver of the munition by placing the munition at the appropriate angle-of-attack so that the cross-flow drag or bodylift would maneuver the munition to its aimpoint. The munition incorporates a wrap-around tail system to allow it to be packaged efficiently in the tactical munitions dispenser. The countermine munition includes the guidance and control system incorporating a GPS guidance concept, jet reaction control system, and associated antennas and electronic processing. It includes a countermine high temperature incendiary dart dispensing system containing, typically, 1,000 countermine darts and a rocket motor system to accelerate the countermine munition when it reaches it aimpoint over the minefield.

Figure 2:
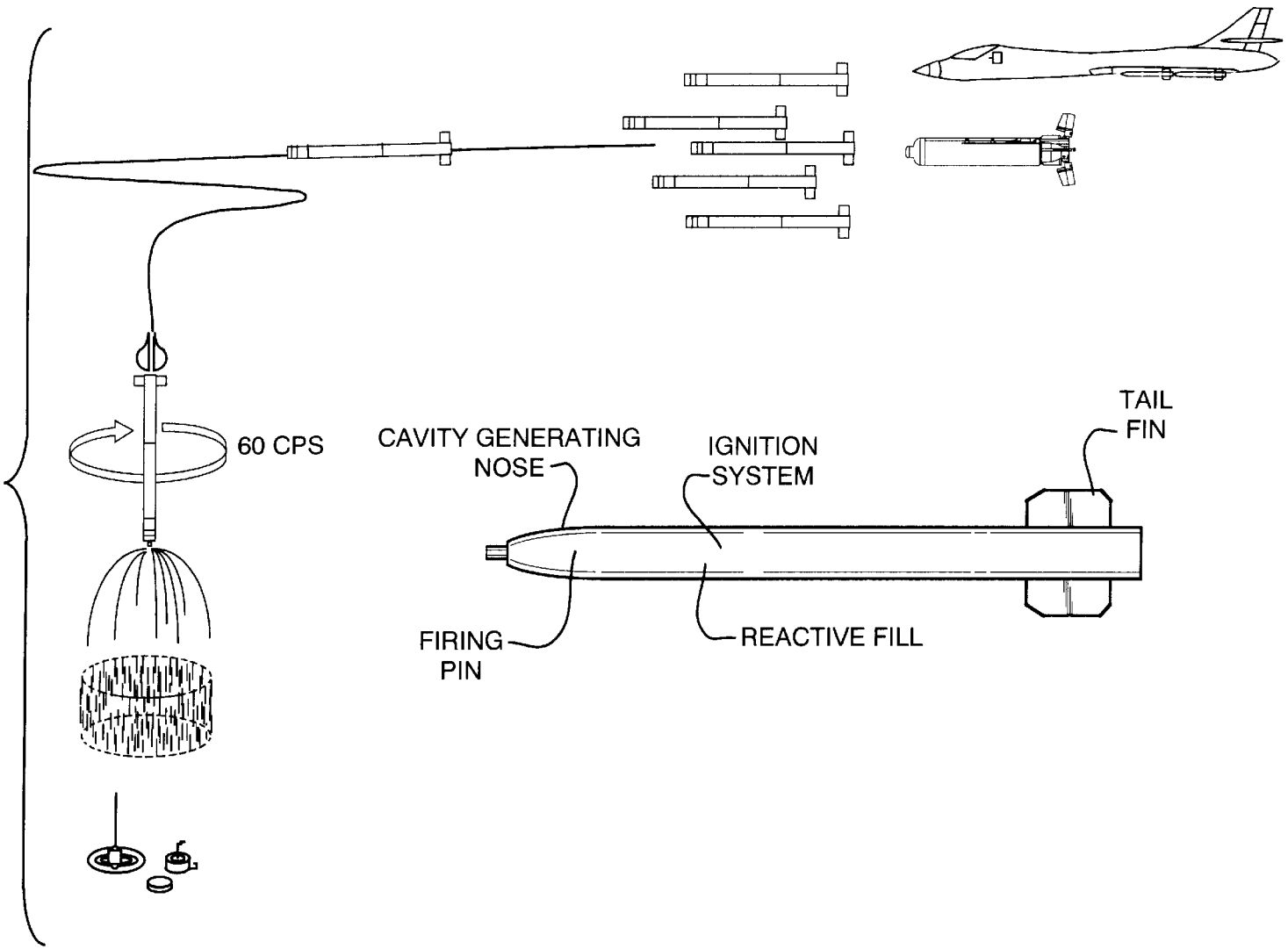
FIG. 2 illustrates the countermine system high temperature incendiary flechettes or darts and delivery elements in overview.

The delivery of countermine munitions using the tactical munitions dispenser allows the GPS precision guidance countermine munitions to position themselves over their aimpoints in the minefield at which point, subsequent to acceleration by the rocket motor, they dispense the high temperature incendiary countermine flechettes or darts. These flechettes each comprise a cavity generating nose geometry, active ignition system employing a firing pin approach, reactive fill, body assembly, and tailfins to allow them to penetrate the soil or water overburden of the mine or the mine directly in surface positioned mines to fracture the mine fill and ignite that fill to cause deflagration or detonation using the high temperature incendiary fill contained in the countermine dart. (FIG. 2).

Figure 3:
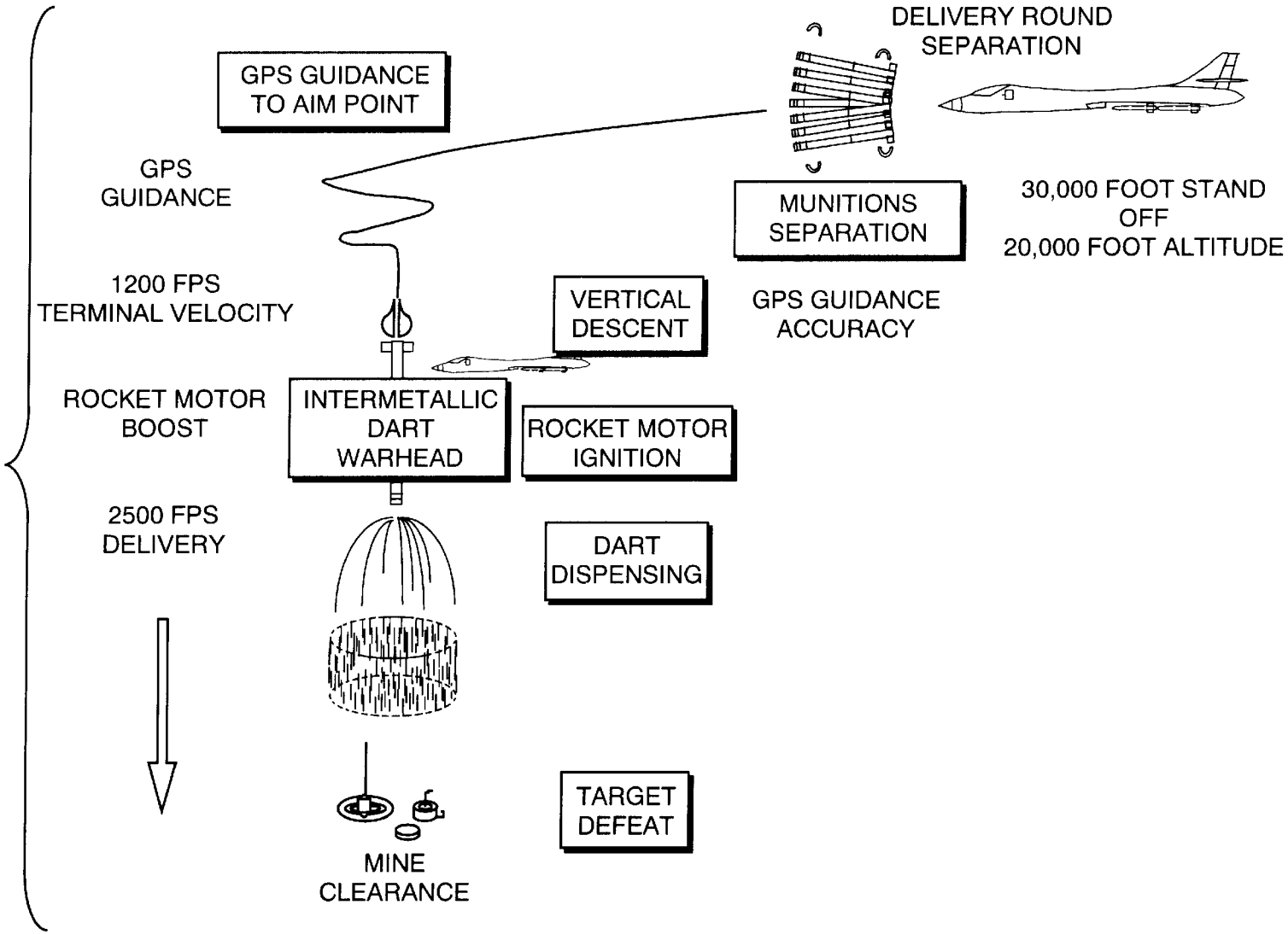
FIG. 3 illustrates the delivery sequence associated with an air-delivered countermine system.

In engaging a target, the aimpoints on the target would be determined in the munition computer planning load and uploaded into the tactical munitions dispenser in sets of five dispensers. The tactical munitions dispenser munition #1 would accept the upload for target aimpoint one. Munition #2 would accept the target upload for aimpoint 2 and so on. Both primary and secondary target aimpoint ensembles would be input into each tactical munitions dispenser. An aircraft would deliver up to eight tactical munitions dispensers at a 30,000-foot stand-off range and 20,000 altitude with each munitions dispenser being dropped from the aircraft utilizing conventional aircraft delivery techniques. Subsequent to the release from the aircraft, each tactical munitions dispenser would cut the skins off the dispenser using a circular forward cutting charge and circular aft cutting charge on a forward and aft bulkhead and three longitudinally-oriented cutting charges releasing the skins containing the countermine munitions. At this point, typically, a forward and aft bladder gas generator would be fired to inflate bladders and eject the countermine munitions from the dispensing system. Subsequent to the ejection from the tactical munitions dispenser each countermine munition would reacquire the GPS satellite ensemble information which it employed during carriage on the aircraft to determine its position in the pre-launch mode from the aircraft initial point. Initially, the countermine munitions contained in the tactical munitions dispenser would acquire the GPS ensemble utilizing the aircraft GPS receiver and the MIL-STD-1553 data bus and -1760 interface to the tactical munitions dispenser carried on the GPS receiver. This allows the GPS receivers and each of the countermine munitions to quickly reacquire the GPS satellite ensemble subsequent to separation from the tactical munitions dispenser in the event that it lost track of the GPS satellite systems. Subsequent to reacquiring the GPS satellite information each munition would determine its position and the position of its target GPS coordinate frame. The position of the target in terms of latitude, longitude, and elevation would be subtracted from the GPS coordinate systems being determined by the countermine munitions allowing the countermine munition to fly in a relative frame as taught by Mayersak in U.S. Pat. No. 5,866,838. The munitions would each then guide to the point over the target assigned to it utilizing the inverse guidance law of the jet reaction control system to effect maneuver to the aimpoints in such a way that each countermine munition would position itself over the target in a vertical descent at the aimpoint. As the munition passed through its aimpoint located over the minefield, a rocket motor would be ignited. The 1,200 foot-per-second terminal velocity of the countermine munition would be increased by the rocket motor burn to approximately 2,500 feet-per-second. In addition, the rocket motor would, utilizing a fluted rocket nozzle, spin the munition up to 60 cycle-per-second. At this point, the countermine munition dispensing system would be initiated and the 1,000 high temperature incendiary countermine darts would be dispensed under centrifugal force in a uniform pattern over the mine target. Each high temperature incendiary countermine dart would be delivered at 2,500 feet-per-second and would impact the surface mines or buried mines or underwater mines to penetrate into the mine, fracture and crack the mine high explosive fill, and, using high temperature incendiary fills in the countermine dart, initiate the mine high explosive fill to cause it to detonate or deflagrate defeating the mine. (FIG. 3).

The dispensing system altitude is selected such that the centrifugal dispersion of the darts form a pattern having a radius of approximately 15 feet with the spacing between the darts such that a mine located in the pattern would be impacted by at least one or more darts.

Figure 4:
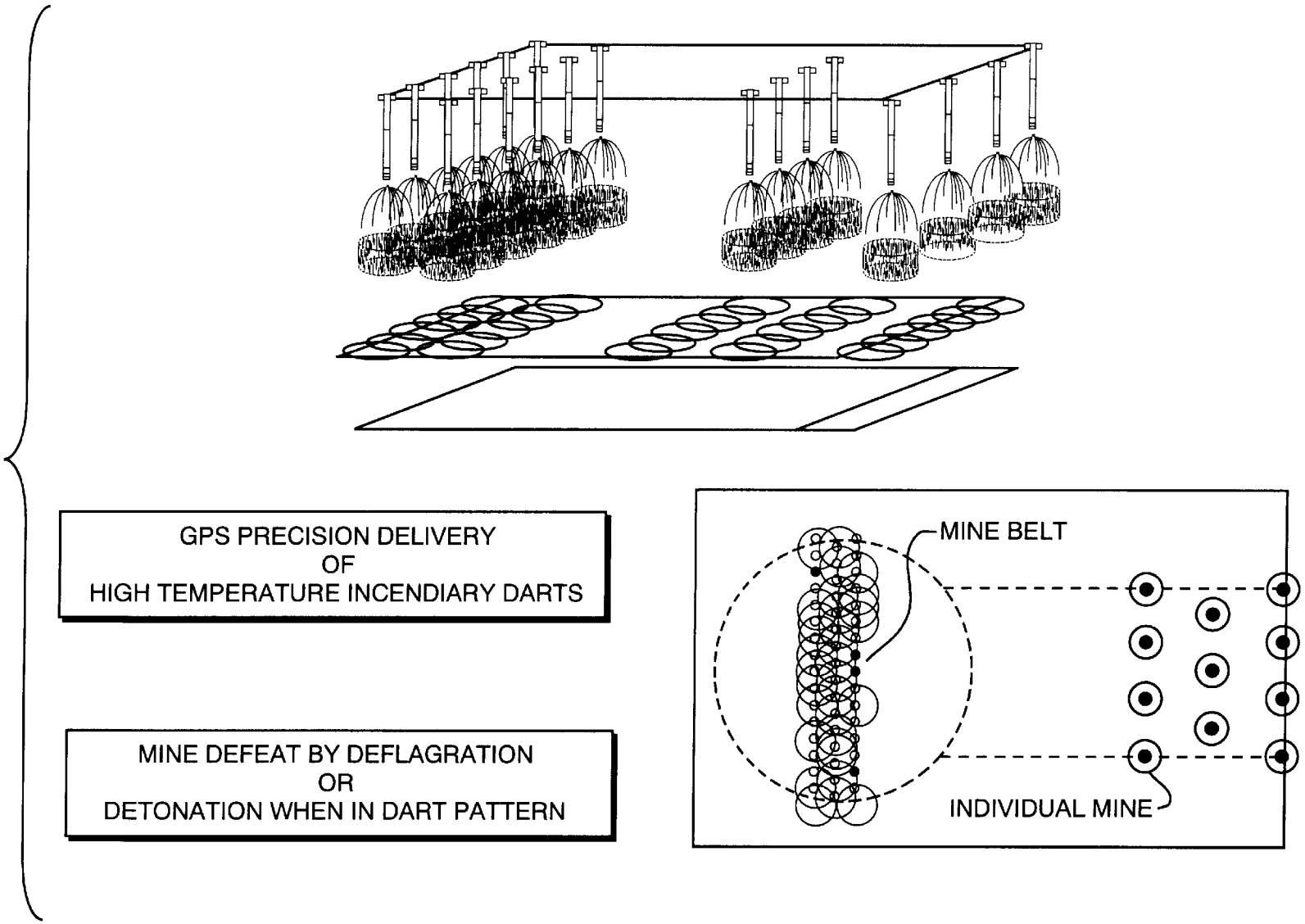
FIG. 4 illustrates the approach for clearing a beach zone target using multiple countermine munitions delivering high temperature incendiary countermine darts or flechettes.

Since a single aircraft has the ability of delivering a multiple of tactical munitions dispensers and can deliver up to forty munitions, a multiple aircraft attack has the potential of clearing a corridor, in the case of amphibious operation, in a minefield consisting of mine belts and individually located mines in either the beach zone or surf zone in stride in a extremely short time. (FIG. 4). The GPS delivery of a large number of high temperature incendiary countermine darts will defeat surface and buried mines in the beach zone and mines underwater in the surf zone to allow combat forces to be deployed ashore.

Figure 5:
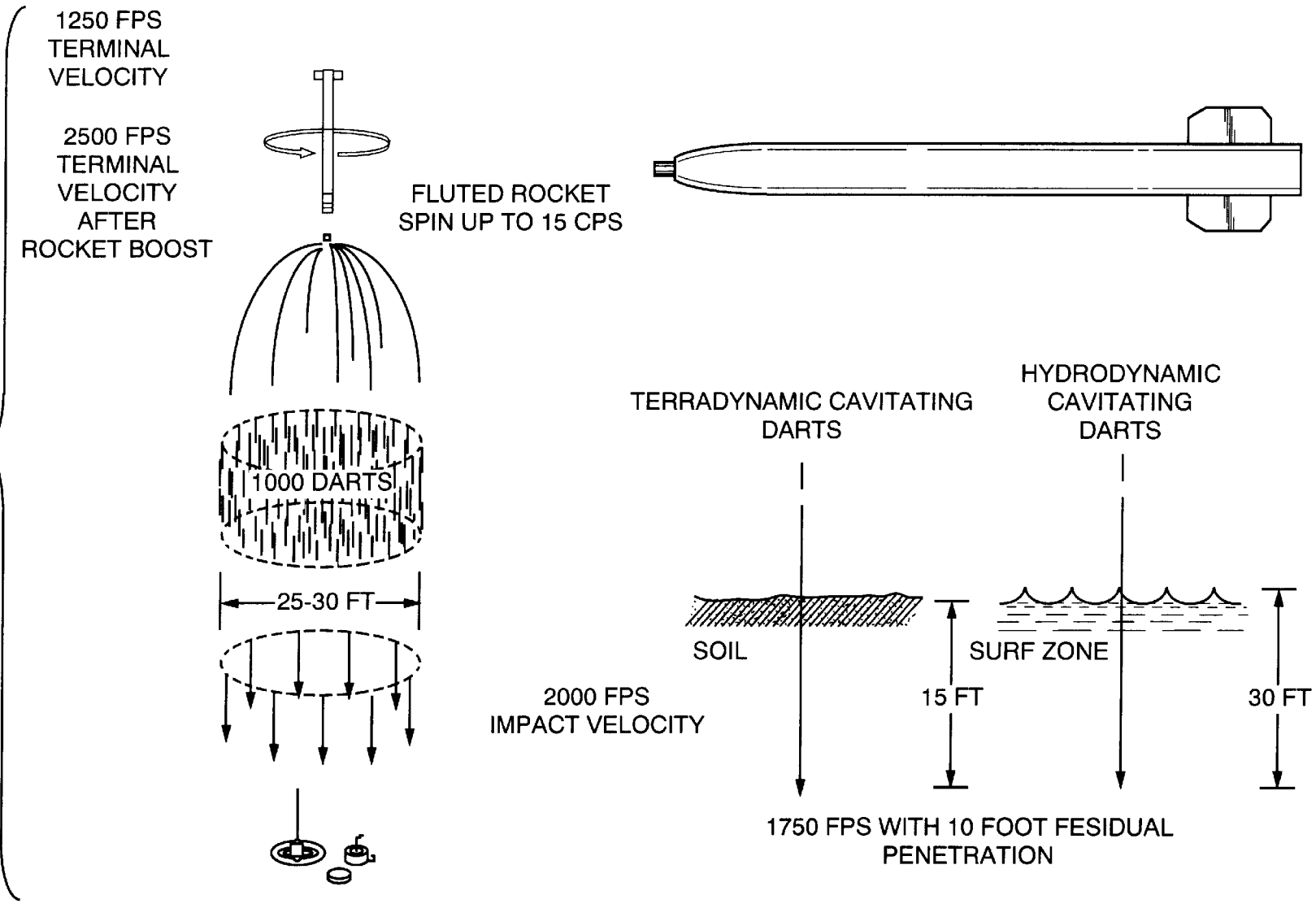
FIG. 5 illustrates the countermine high temperature incendiary dart or flechette design features and the aerodynamic and hydrodynamic cavitating concept for penetrating soil and water to reach the anti-tank and anti-vehicle mines.

The high temperature incendiary delayed ignition countermine dart is designed to be able to defeat mines both on the surface and buried in soil or underwater in the beach zone and surf zone. (FIG. 5). The high temperature incendiary countermine dart penetrates to the mine located underwater in the surf zone using hydrodynamic cavitation or supercavitating concepts where the cavity is generated by the forward nose pin extending from the front of the dart. The high velocity of the dart and the nose pin creates a hydrodynamic cavity allowing the dart to penetrate with little loss in velocity due to the fact that the drag of the dart is essentially that associated with the diameter of the nose pin and not the diameter of the high temperature incendiary countermine dart. A similar effect has been shown in penetrating soil where a terradynamic cavity is created by the hardened tungsten nose pin in the dart allowing the dart to penetrate into the soil with minimum drag. The terradynamic cavity effect and hydrodynamic cavity effect generated by the dart allows the dart to incorporate a delayed ignition geometry in the ignition system which enables the dart to penetrate to the mine and enter the mine before it initiates its high temperature incendiary fill ensuring that the mines are defeated and that the high temperature incendiary fill is not prematurely initiated.

Dart Fill And Cavity Effect

Figure 6:
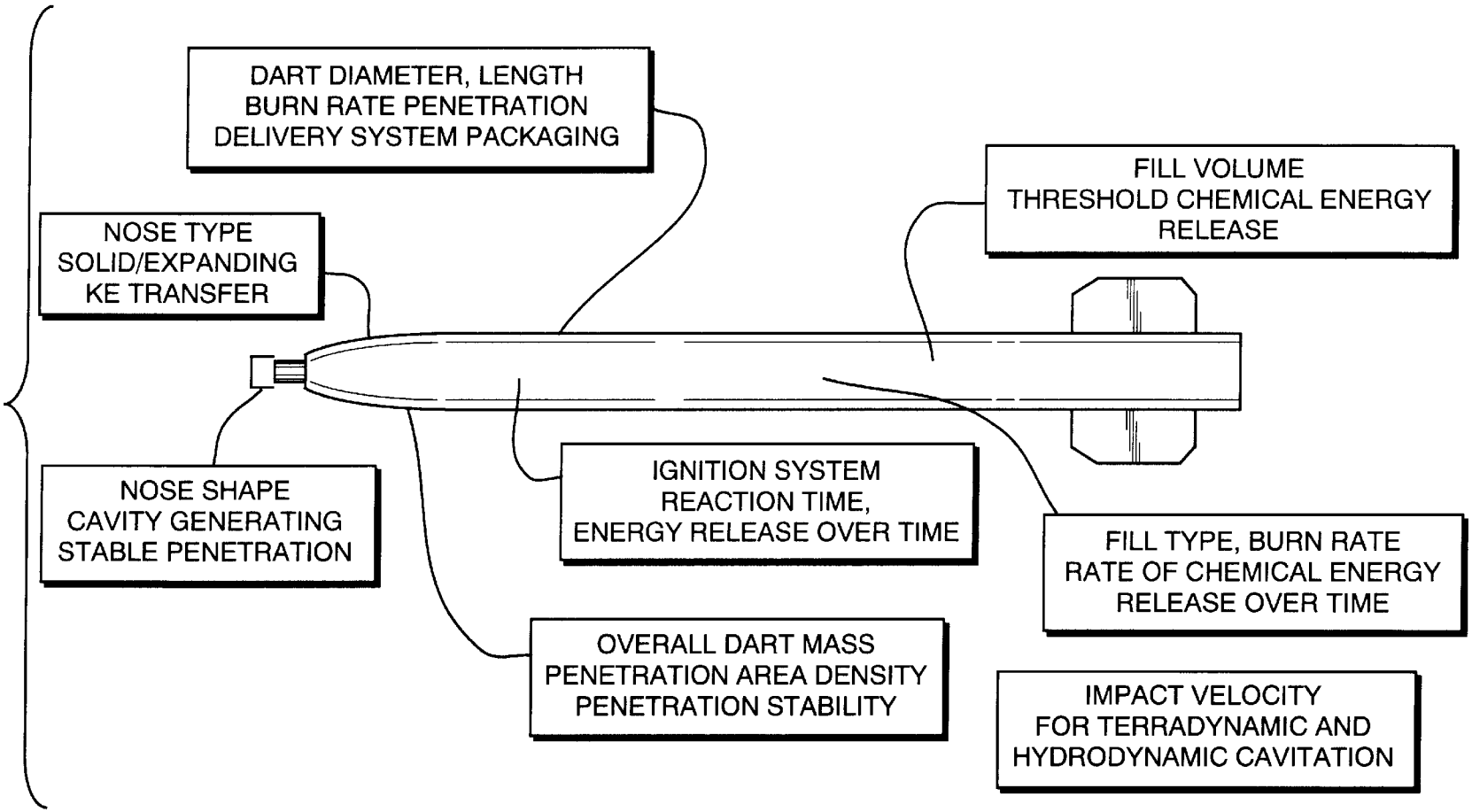
FIG. 6 illustrates the various dart design factors involved in defining a countermine high temperature incendiary flechette or dart.
Figure 7:
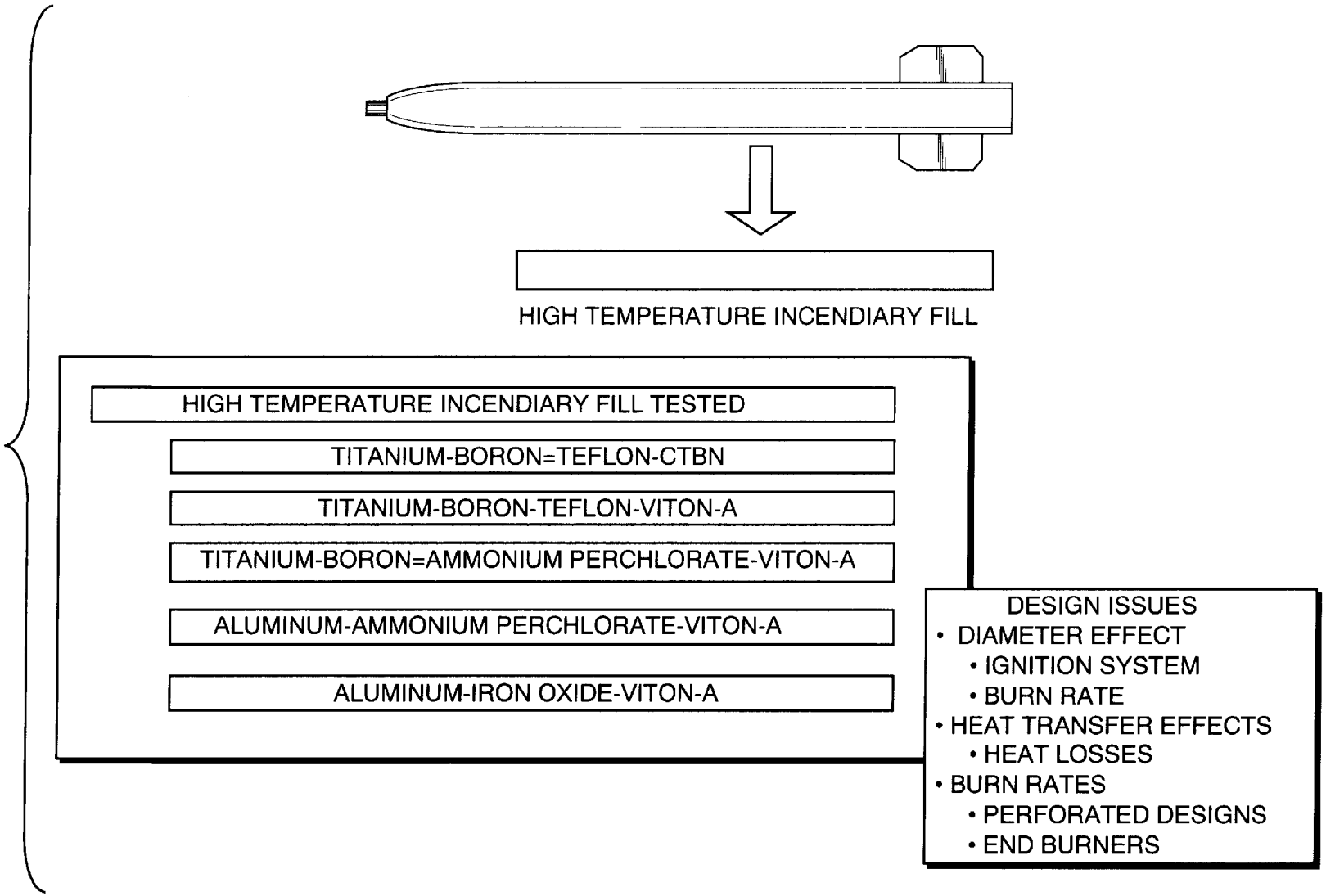
FIG. 7 illustrates high temperature incendiary fills which may be employed in the countermine high temperature incendiary flechette or dart.
Figure 8:
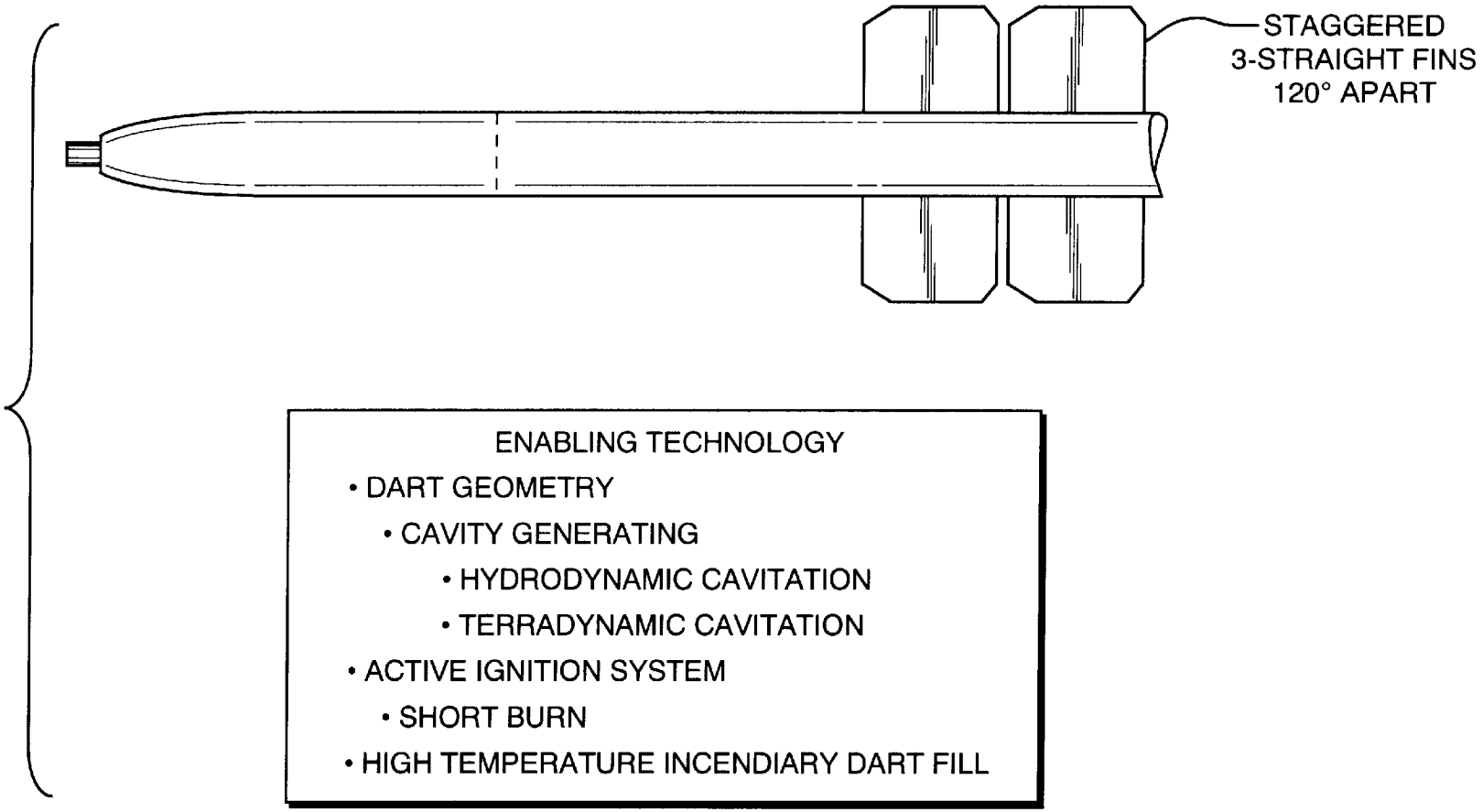
FIG. 8 illustrates a high temperature incendiary countermine dart or flechette.

The high temperature incendiary delayed ignition countermine dart incorporates unique design factors to allow it to be employed in defeating surf zone and beach zone anti-tank and anti-vehicle mines. The dart employs:

a. A cavity-generating nose shape to allow the dart to penetrate in a hydrodynamic cavitating and terradynamic cavitating mode in stable penetration to reach the mine.

b. A kinetic energy penetrator nose incorporating an expanding nose to increase the break-up and cracking of the mine fill due to kinetic energy transfer.

c. A delayed ignition system which ignites the high temperature incendiary fill to react the fill over a 50 microsecond time at impact with the plastic or steel-cased mine to ensure that the thermal energy from the burning fill will be deposited in the mine and will result in the deflagration/detonation of the mine.

d. Overall dart design including mass, diameter, and length to allow the dart to act as a kinetic energy penetrator during the penetration of soil or water to ensure that the dart possesses sufficient kinetic energy on impacting the mine to cause mine explosive fill break-up and fracture.

e. Dart diameter and length to allow maximum number of darts to be packaged in the countermine munition.

f. High temperature incendiary fill to allow large amounts of chemical energy to be released over short periods of time. (FIG. 6). The dart high temperature incendiary fill employs an active ignition system to shock the fill up to reaction. High temperature incendiary fill candidates include titanium-boron-Teflon with CTBN as the binder, titanium-boron-Teflon with VitonA as the binder, titanium-boron with ammonium perchlorate with VitonA as the binder, aluminum potassium perchlorate with VitonA as the binder and aluminum iron oxide with VitonA as the binder. These fills and high explosive fills may be employed in the countermine dart. The problem experienced with trying to package high temperature incendiary or explosive fills in small diameter countermine flechettes or darts is that it is difficult to ignite the fill in small calibers and maintain high velocity bum rates even in perforated fill designs. End-burners, as compared to perforated fill designs, burn at even slower burn rates and the ability to maintain the burn, due to heat transfer losses during the bum to the case of the countermine dart, is difficult. (FIG. 7). The use of an active ignition system overcomes all of these design issues allowing any one of a number of high temperature incendiary high explosive fills to be employed. The exact geometry of a high temperature incendiary countermine dart incorporates the cavity generating design features allowing hydrodynamic cavitation and terradynamic cavitation to be employed in high-speed penetration of soil and water, and an active ignition system to allow the dart fill to be shocked to reaction using a high temperature incendiary fill. The darts would also incorporate a staggered tail system to allow maximum number of darts to be packaged in the countermine munition dispensing system. (FIG. 8).

Figure 9:
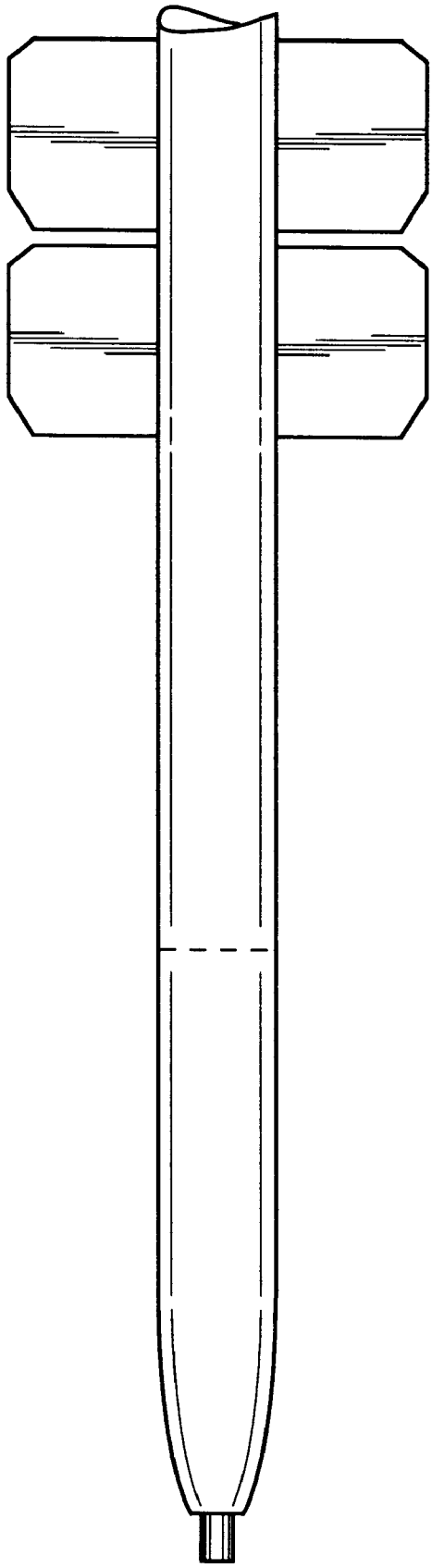
FIG. 9 illustrates a staggered tail packaging concept for the high temperature incendiary countermine dart to increase packaging efficiency in the countermine munition.
Figure 10:
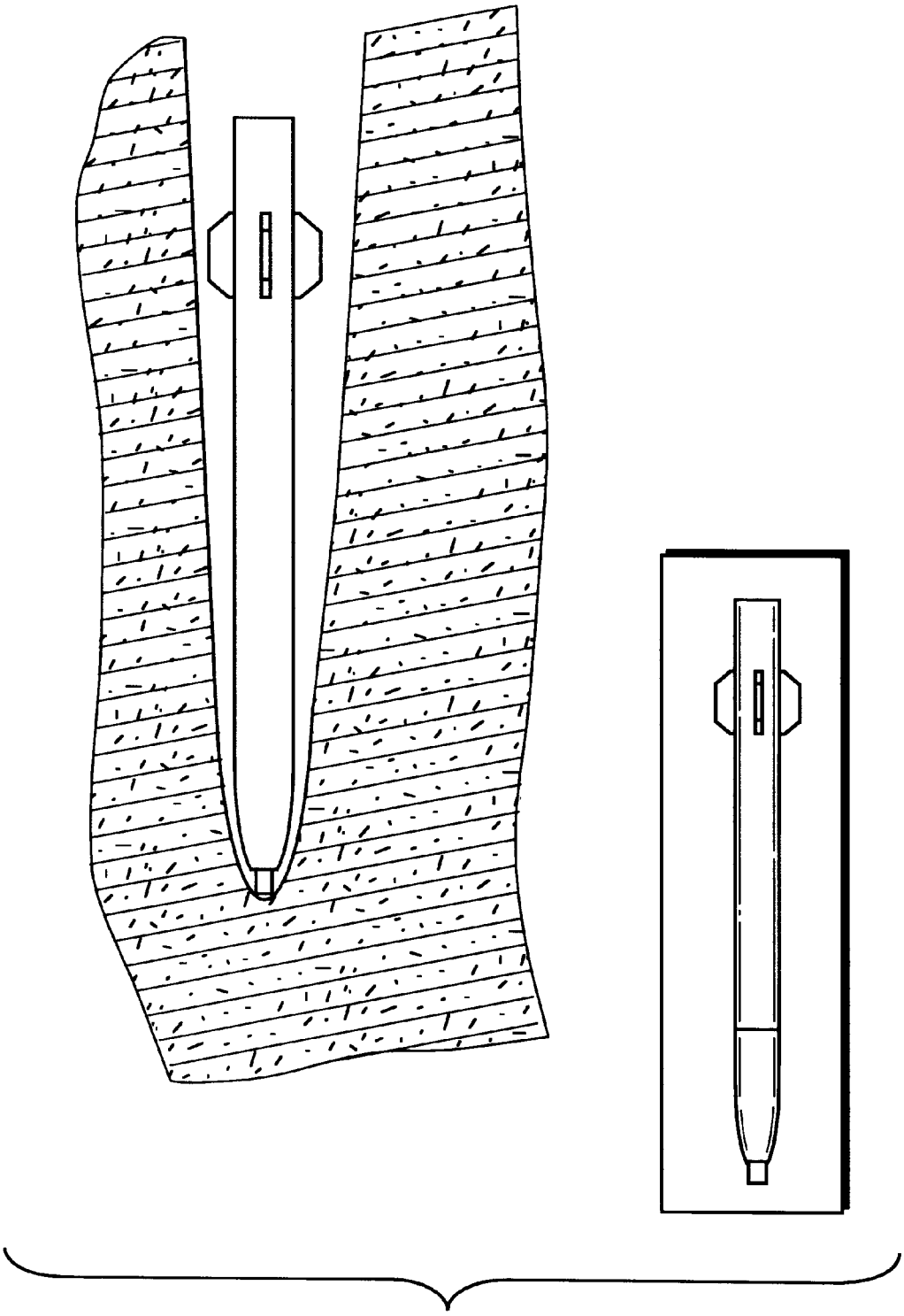
FIG. 10 illustrates the hydrodynamic cavity cavitating dart effect generated by the high velocity, high temperature incendiary countermine dart during penetration of water.
Figure 11:
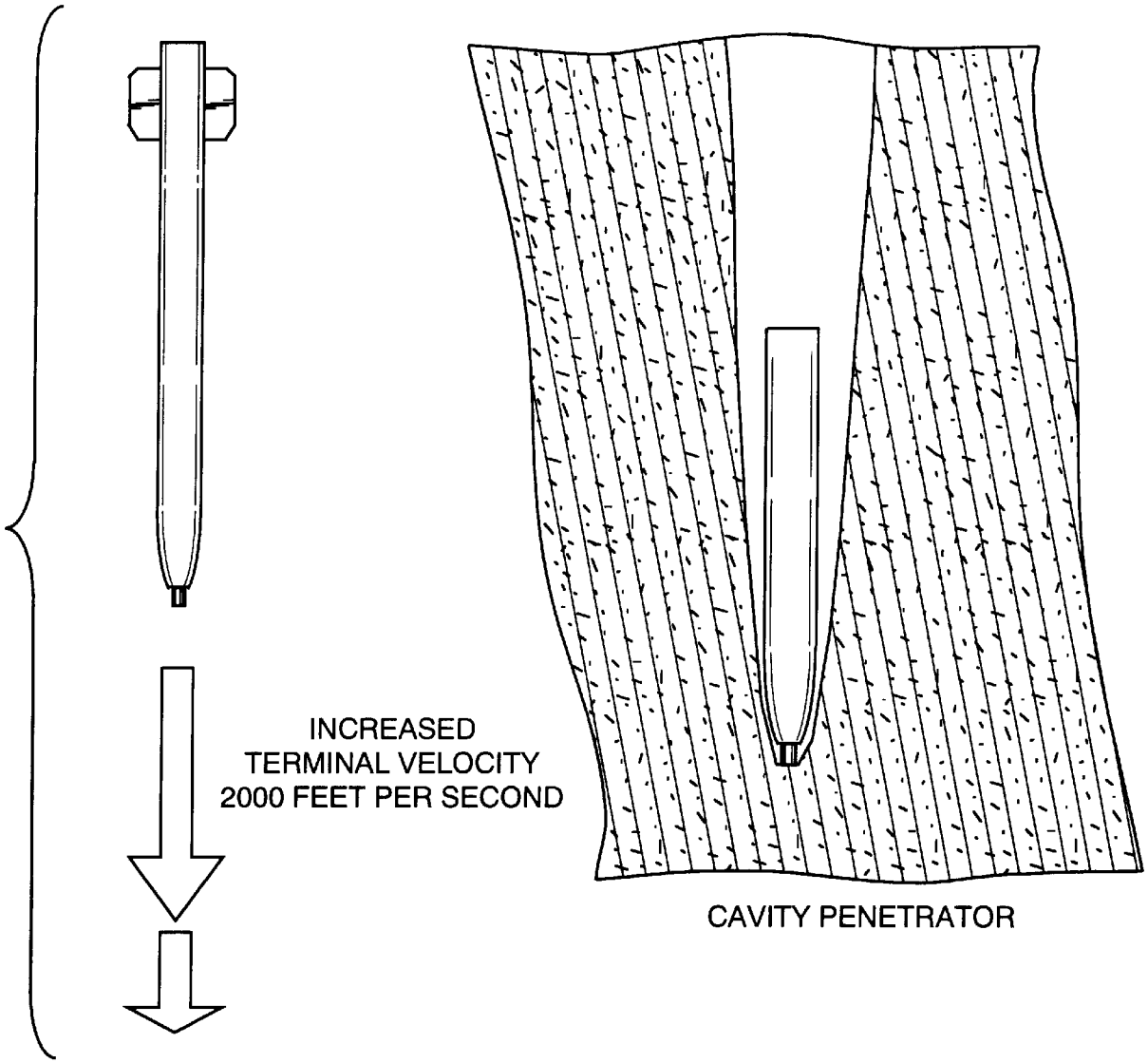
FIG. 11 illustrates the terradynamic cavitating effect generated by a high velocity, high temperature incendiary countermine dart when penetrating soil.
Figure 12:
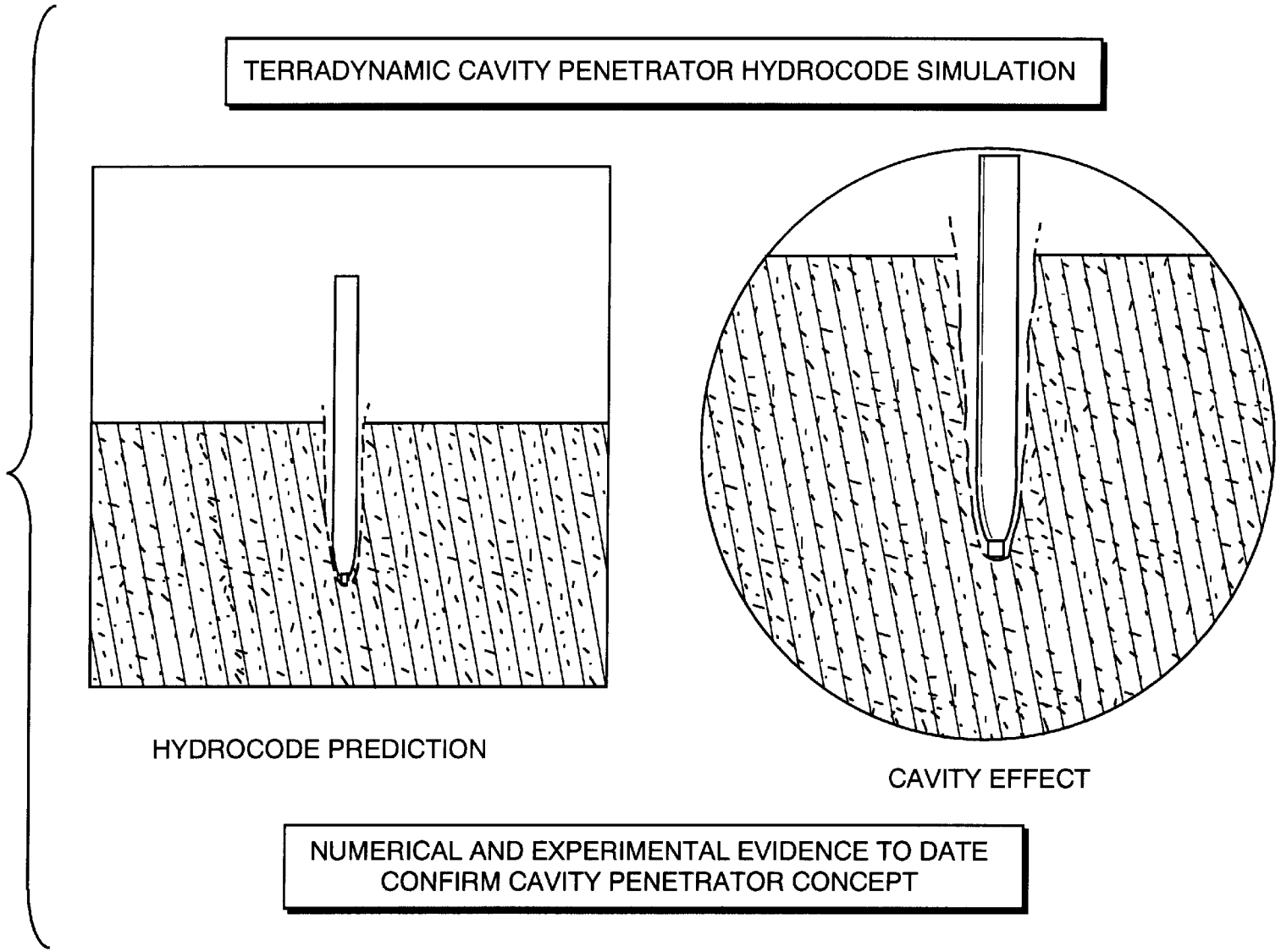
FIG. 12 illustrates hydrocode analysis verifying that a high velocity countermine high temperature incendiary dart, properly designed, when penetrating soil would create a terradynamic cavity.

The staggered tail concept for the countermine dart allows the packaging of the darts to be extremely compact in the dispensing system. (FIG. 9). The key to utilizing a delayed ignition system is the ability to generate a cavity during the penetration of soil and water. The ability of projectiles to generate these cavities in penetrating water has well been known in the state of the art. Supercavitating projectile designs are well understood. The countermine dart incorporates some features of well-known supercavitating geometries but departs from the usual approach in that the stand-off pin located in the nose is an element in the ignition system and provides not only the ability to generate a supercavitation envelope about the dart during penetration of water but provides the ability to hold off the delayed ignition firing pin until the countermine dart strikes the mine and the cavity is lost during the penetration of the mine. (FIG. 10). The supercavitation effect witnessed in penetration of water by the dart is similar to the terradynamic cavitation effect the dart is designed to generate during penetration of soil. The stand-off nose pin of the dart is designed to have the appropriate diameter to allow stable penetration during the penetration of soils while it also generates a cavity about the countermine dart during the penetration process. (FIG. 11) This allows a delayed ignition system utilizing the cavity effect in a two-step approach to be defined for both use in water and in soil, as well as for use in impacting mines mounted on the surface of the soil. The terradynamic cavity-penetrating concept for the high temperature incendiary delayed ignition countermine dart has been verified in hydrocode predictions of the penetration of the dart into soil. (FIG. 12). The ability to generate a cavity during the penetration process reduces the drag on the dart during the penetration allowing deeper depths of penetration to be achieved. The ability to generate a terradynamic cavity is the result of the high velocity of the dart during the penetration which essentially causes the soil to "flow" off the flat of the hardened tungsten nose pin and creates a cavity which has a diameter larger than the diameter of the penetrating countermine dart.

Dart Ignition System

Figure 13:
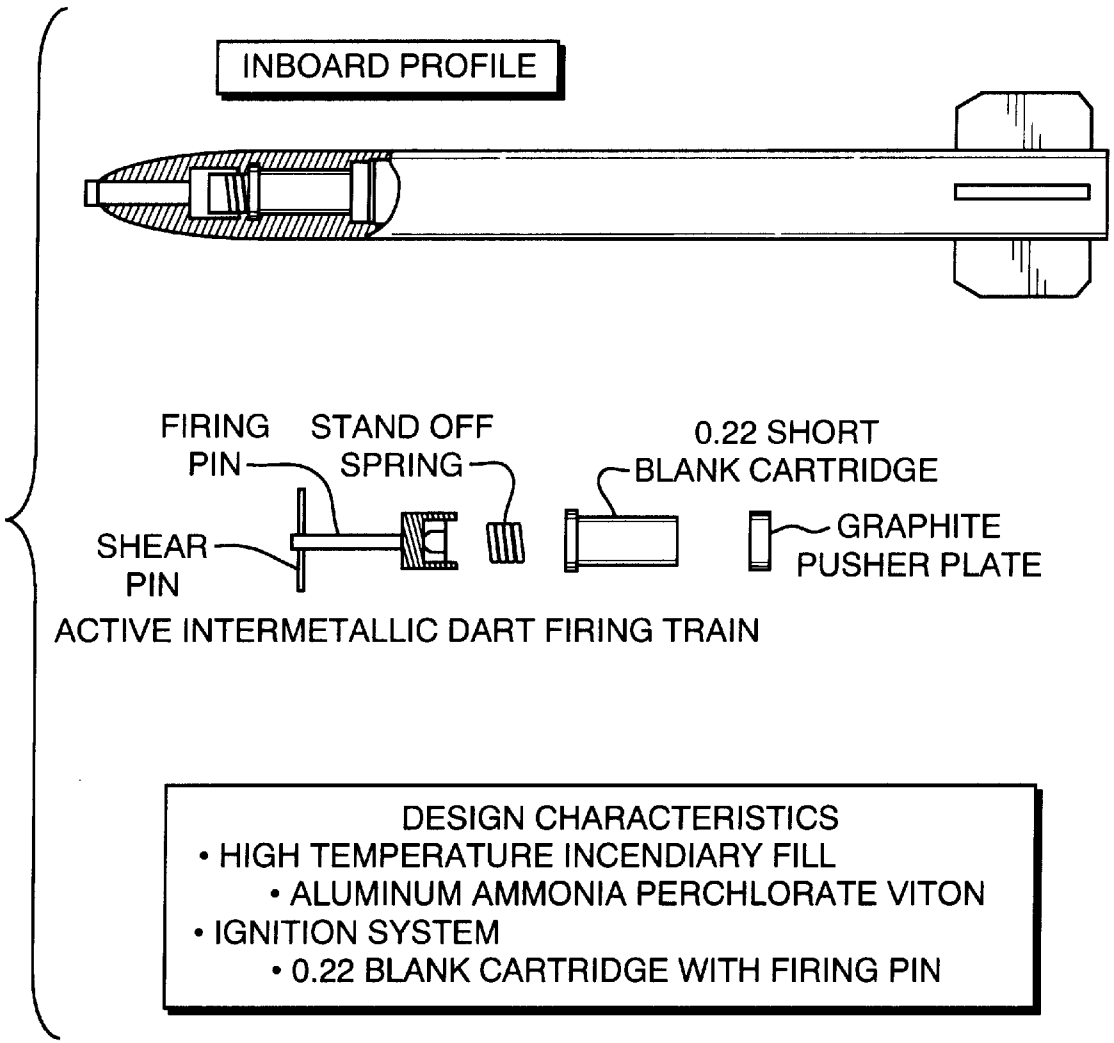
FIG. 13 illustrates a high temperature incendiary countermine dart incorporating a 0.22 caliber blank cartridge active ignition system.

The dart ignition system, in its simplest form, uses a stand-off nose pin as the firing pin in an ignition system similar to those employed in firearms. One form of ignition system is a 0.22 caliber blank cartridge consisting of a firing pin, a shear pin, a stand-off spring, a 0.22 caliber short blank cartridge and a graphite pusher plate. (FIG. 13). A standard shear pin holds the firing pin assembly in place by anchoring it to the dart nose head. Upon impact with a surface mine, the shear pin shears and the firing pin is driven backwards against the stand-off spring impacting the rim of the 0.22 caliber short blank cartridge causing the cartridge to fire. The firing of the blank cartridge shocks the fill contained in the dart causing it to deflagrate. Since the dart incorporates a thin wall barrel assembly, the high pressure reaction from the aluminized ammonium perchlorate or aluminized potassium perchlorate or other high explosive fills fractures the barrel assembly and instantly releases the energy from the reaction into the mine. The reaction time from the point at which the dart hits the mine to the point at which the energy is released is on the order of 50 microseconds. This allows the fill, which is difficult to cause to bum in an ignition concept which lights the fill from an end-burner or perforated center burner to be ignited and shocked to full reaction and bypasses all of the fill burn problems.

Figure 14:
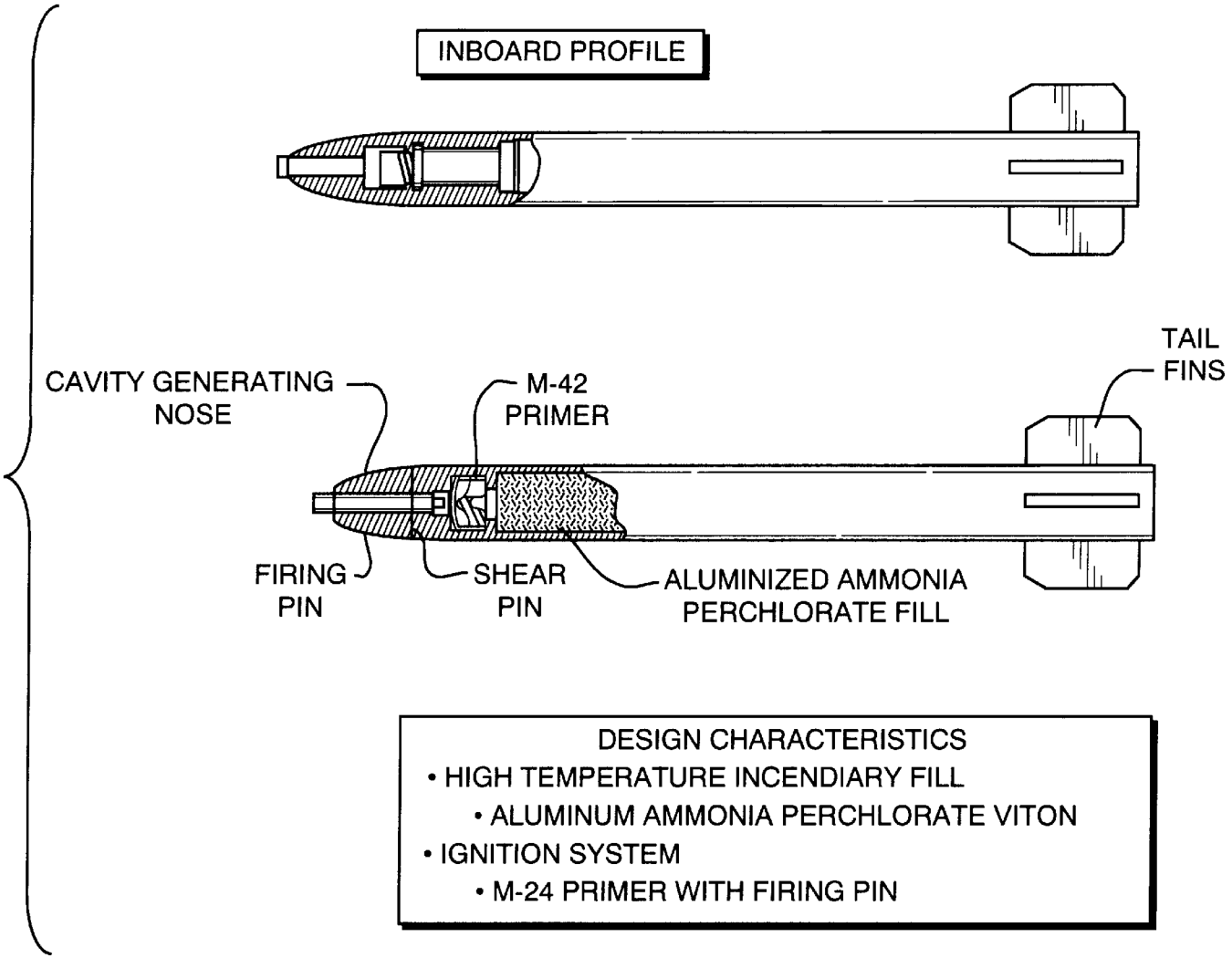
FIG. 14 illustrates a high temperature incendiary countermine dart incorporating a primer active ignition system.
Figure 15:
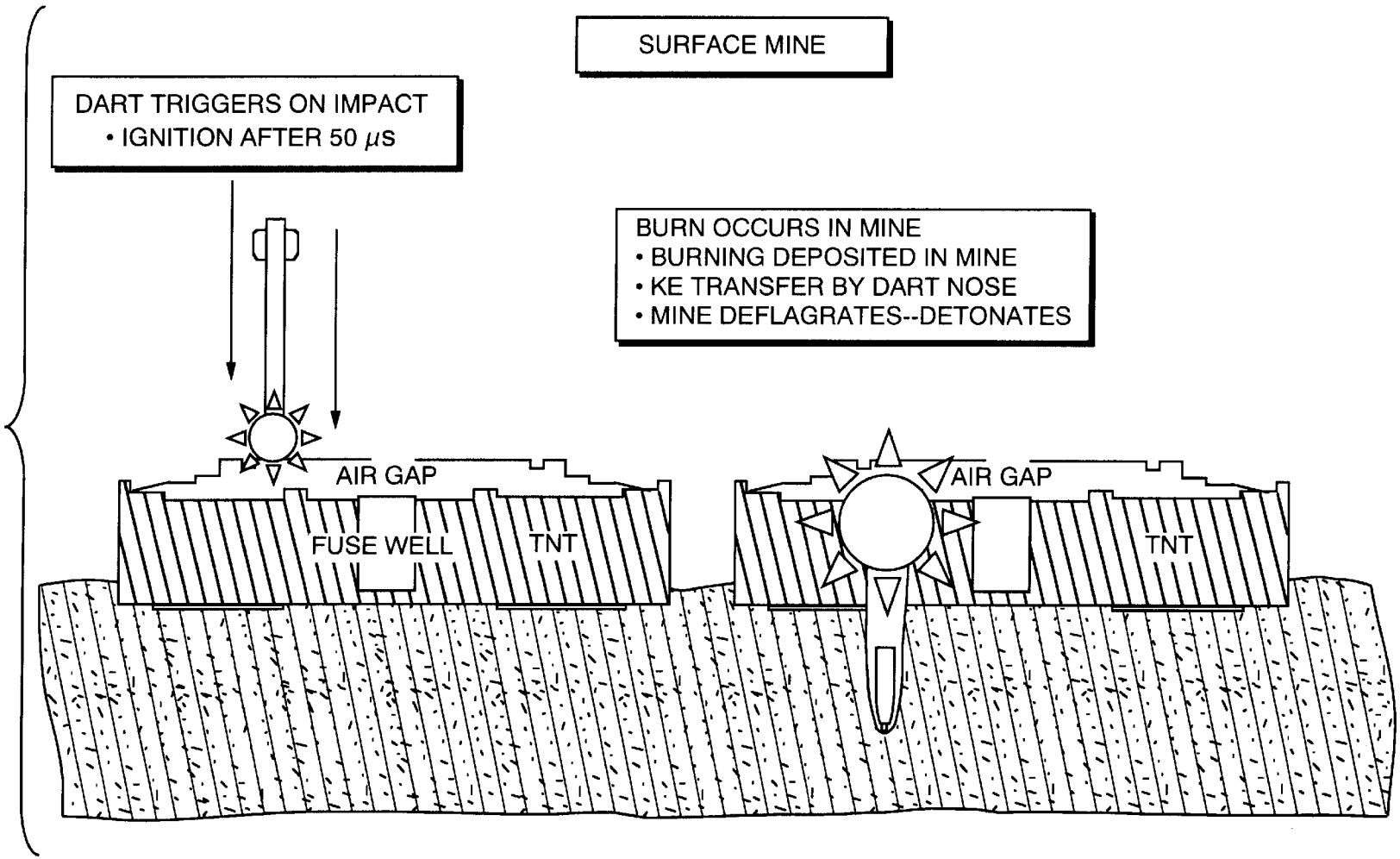
FIG. 15 illustrates the operation of an active high temperature incendiary countermine dart against a surface mine.
Figure 16:
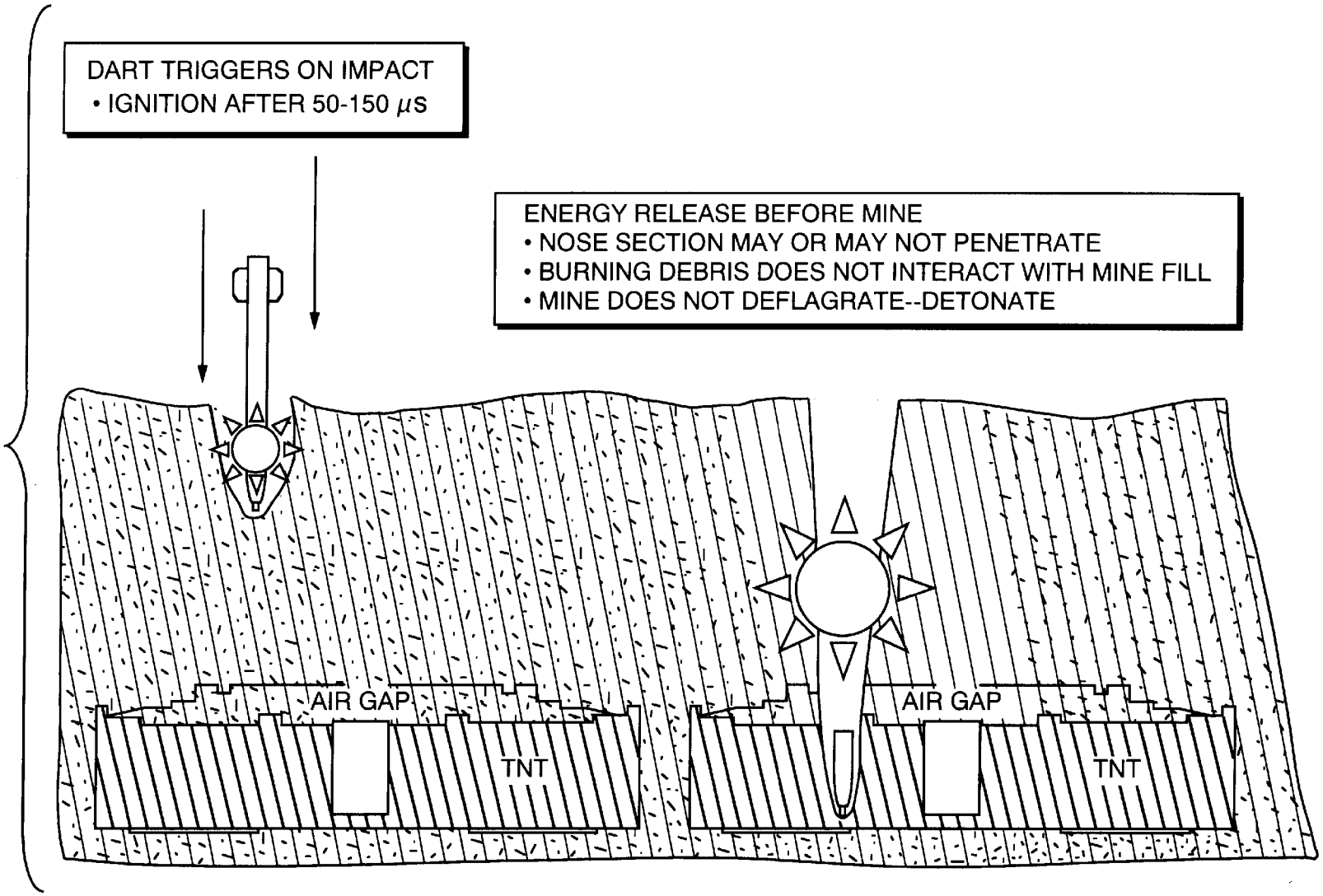
FIG. 16 illustrates the operation of an active countermine high temperature incendiary dart against a buried mine target.
Figure 17:
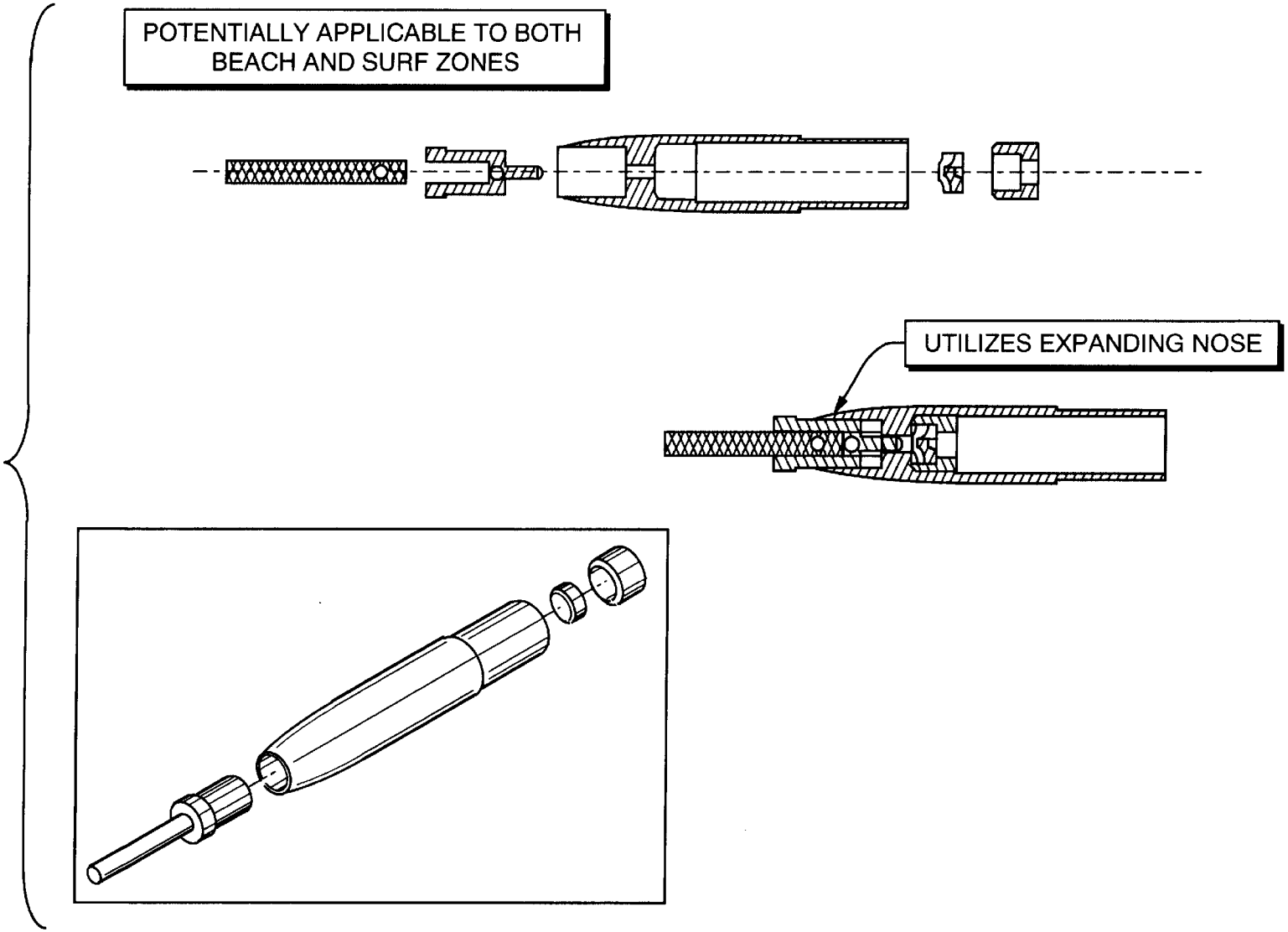
FIG. 17 illustrates a delayed active ignition system for the countermine high temperature incendiary dart.

Any active fulminate element may be used as an active ignition system including conventional large pistol and large rifle primers or small pistol and small rifle primers. Shot shell primers could also be incorporated into the design. The active ignition system using a primer system would utilize the same firing pin concept which would then impact the primer which, in turn, would fire and shock-up the aluminized ammonium perchlorate or other dart fill. (FIG. 14). The use of an active ignition system provides the ability to penetrate a mine and place the reactive materials exactly where the designer would wish. The dart would penetrate the mine and, due to expanding noses and kinetic energy, locally fracture the TNT or high explosive mine fill and propagate cracks in the fill. The high temperature incendiary fill would shock to ignition and the reaction would proceed over a 50 microsecond period causing the barrel assembly of the dart to fracture releasing the burning fill components into the mine to deflagrate or detonate the mine. (FIG. 15). An active ignition dart, however, has no ability to engage and defeat buried mines or mines under the water since the dart would initiate on impact with the soil or water surface. At this point, the firing pin would move back and impact the active element, be that a primer or a blank cartridge, which would, in turn, shock the dart fill causing the high energy release to be deposited in the soil prior to impact with the mine. The nose assembly of the active ignition countermine dart would continue forward due to its stable design and would place a hole in the mine but cannot be assumed to cause the mine to deflagrate or detonate. (FIG. 16). A delayed ignition concept that takes advantage of the terradynamic and hydrodynamic cavitating aspects of the dart design can be defined. The concept embodies a tungsten stand-off pin, M42 primer, and primer holder. In this assembly, the circular sleeve firing pin is inserted into the forward portion of the nose and anchored with a shear pin. This shear pin is designed to fail when the countermine dart impacts with the mine plastic or steel mine case. The stand-off pin is then inserted and anchored to the dart body with a large caliber shear pin designed not to fail under impact. (FIG. 17). In operation, the delayed active ignition countermine dart would impact the soil or water and create a terradynamic or hydrodynamic cavity. The cavity would be such so that the walls of the cavity would clear the forward section of the dart. When the dart strikes the plastic case or steel case of the mine, the forward stand-off pin would penetrate the mine and the cavity would be lost. The mine case would then strike the circular sleeve firing pin driving it rearward, igniting the primer, which would, in turn, shock the high temperature incendiary fill contained in the dart to reaction.

Figure 18:
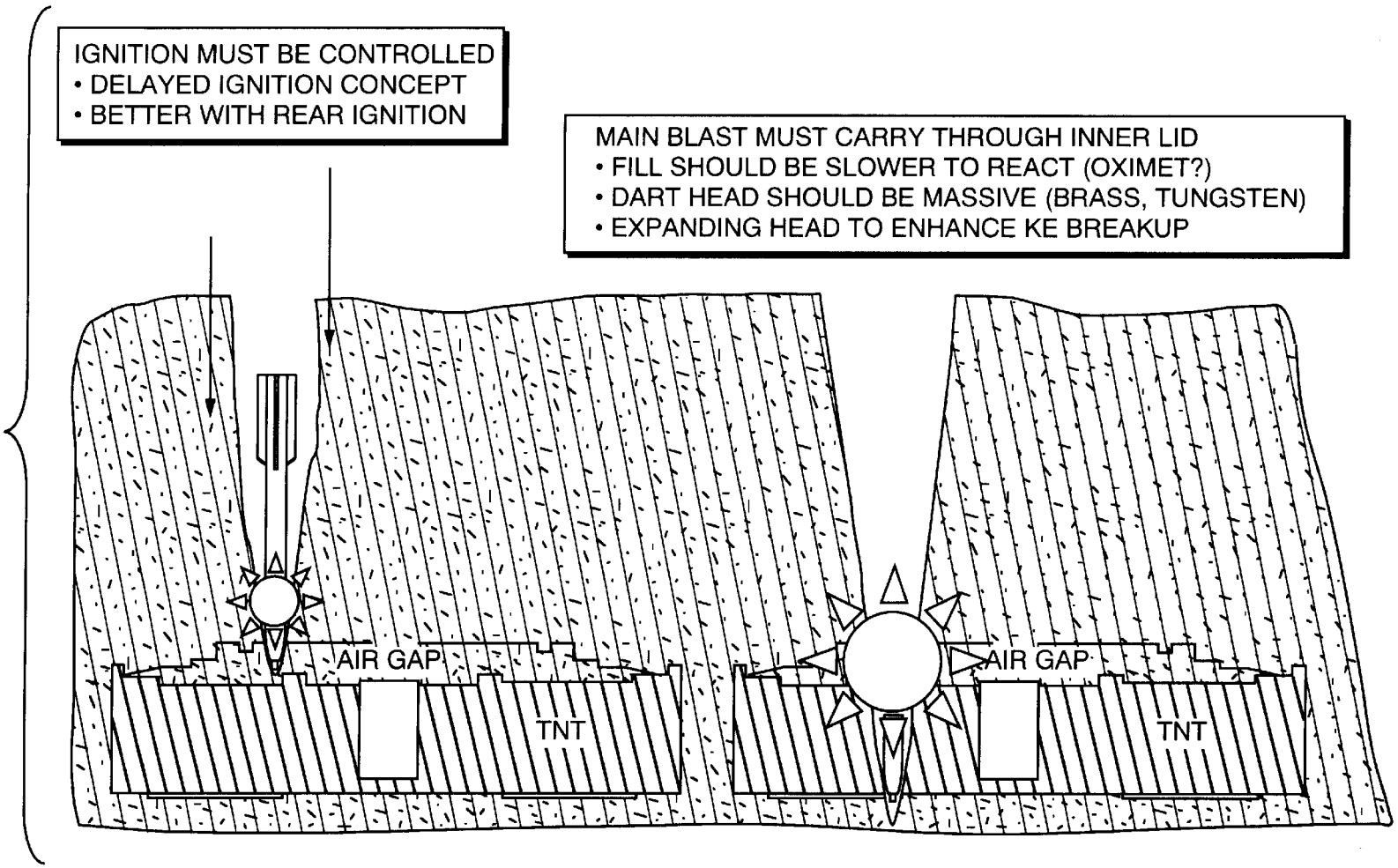
FIG. 18 illustrates the design objectives for a high temperature incendiary countermine dart.
Figure 19:
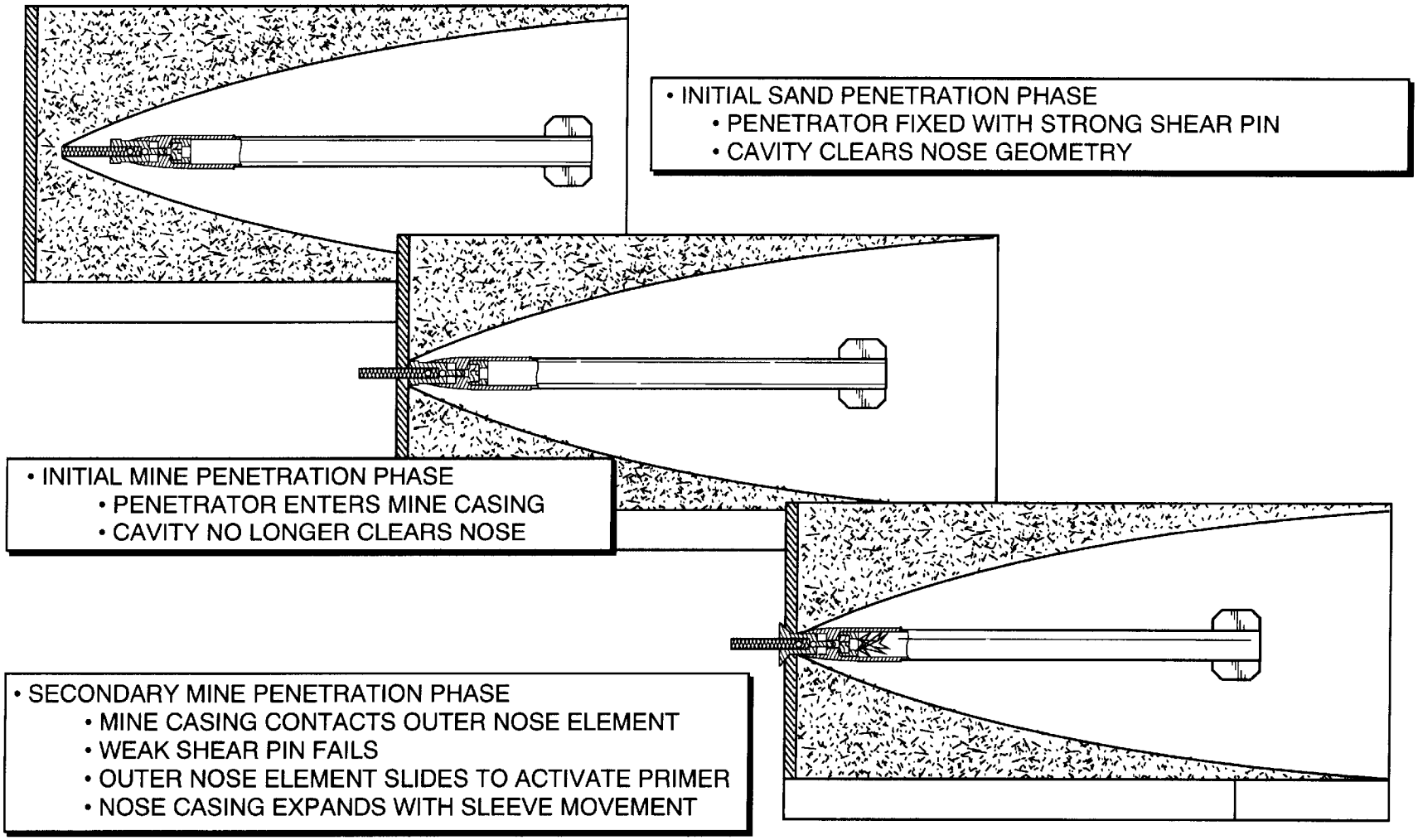
FIG. 19 illustrates the operation of a delayed active ignition system utilizing a high temperature incendiary countermine dart designed to generate a cavity effect during the penetration phase.
Figure 20:
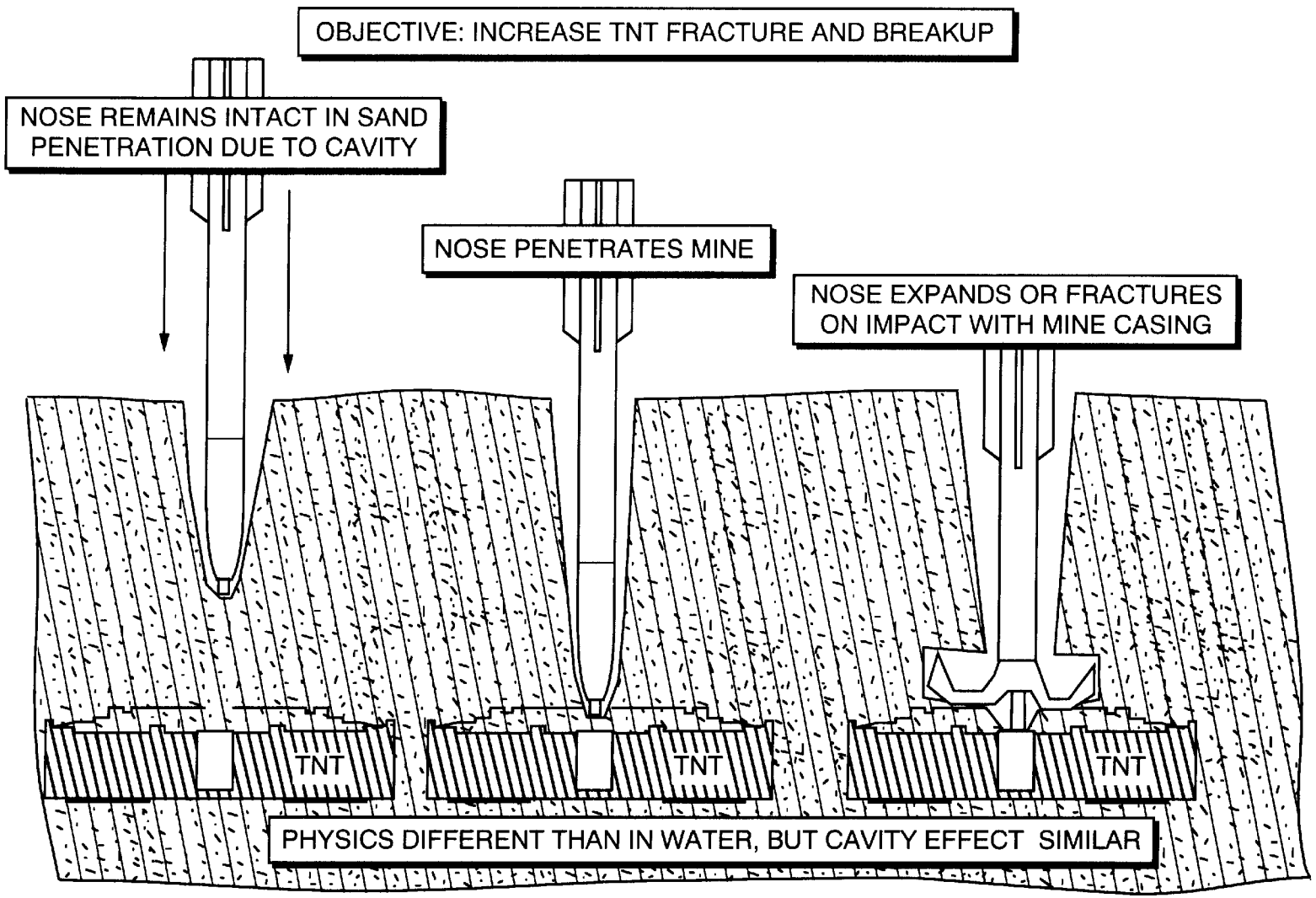
FIG. 20 illustrates the delayed ignition system operation for a countermine high temperature incendiary dart.
Figure 21:
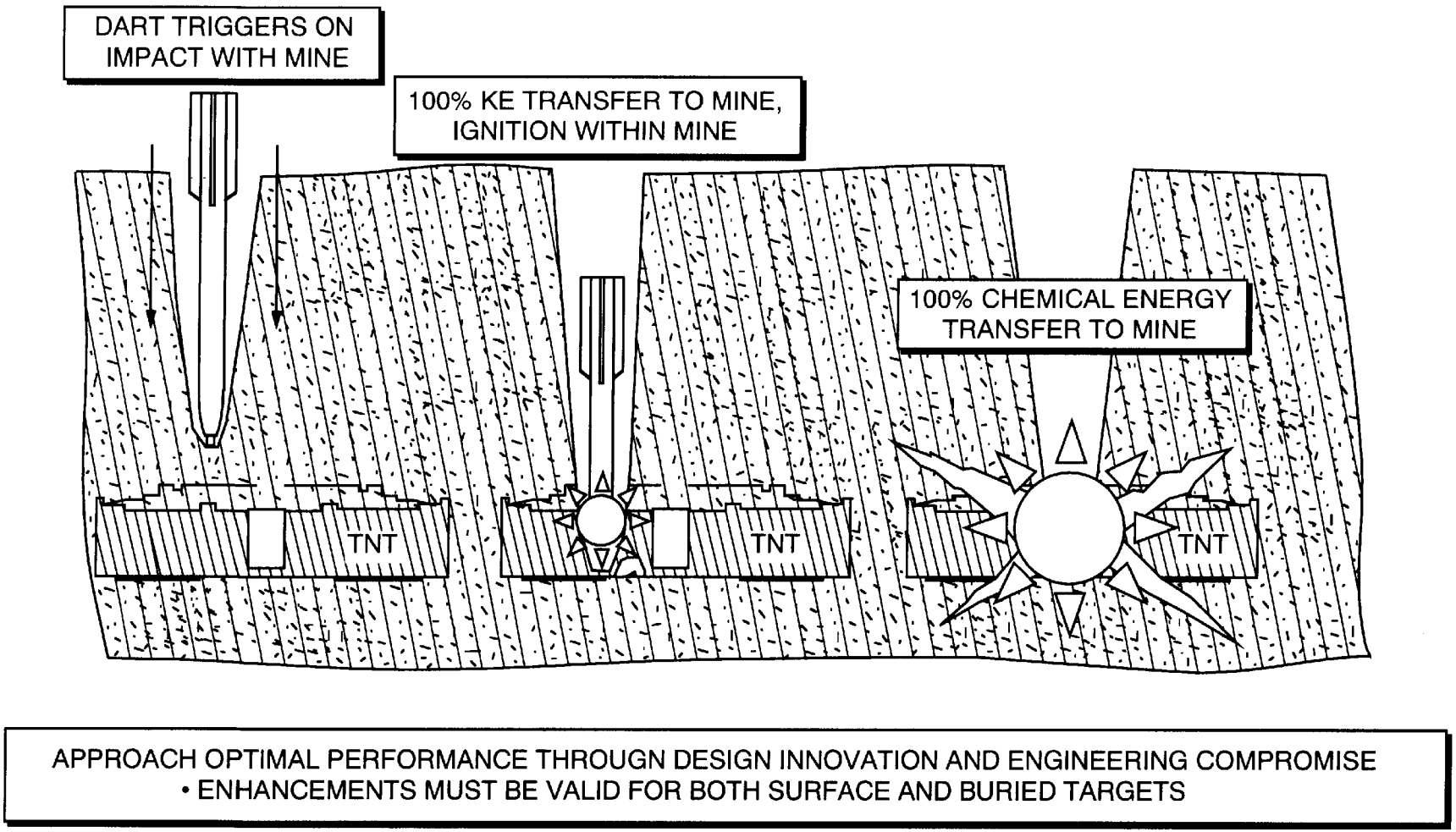
FIG. 21 illustrates the effect of a delayed active ignition high temperature incendiary countermine dart in engaging a buried mine.
Figure 22:
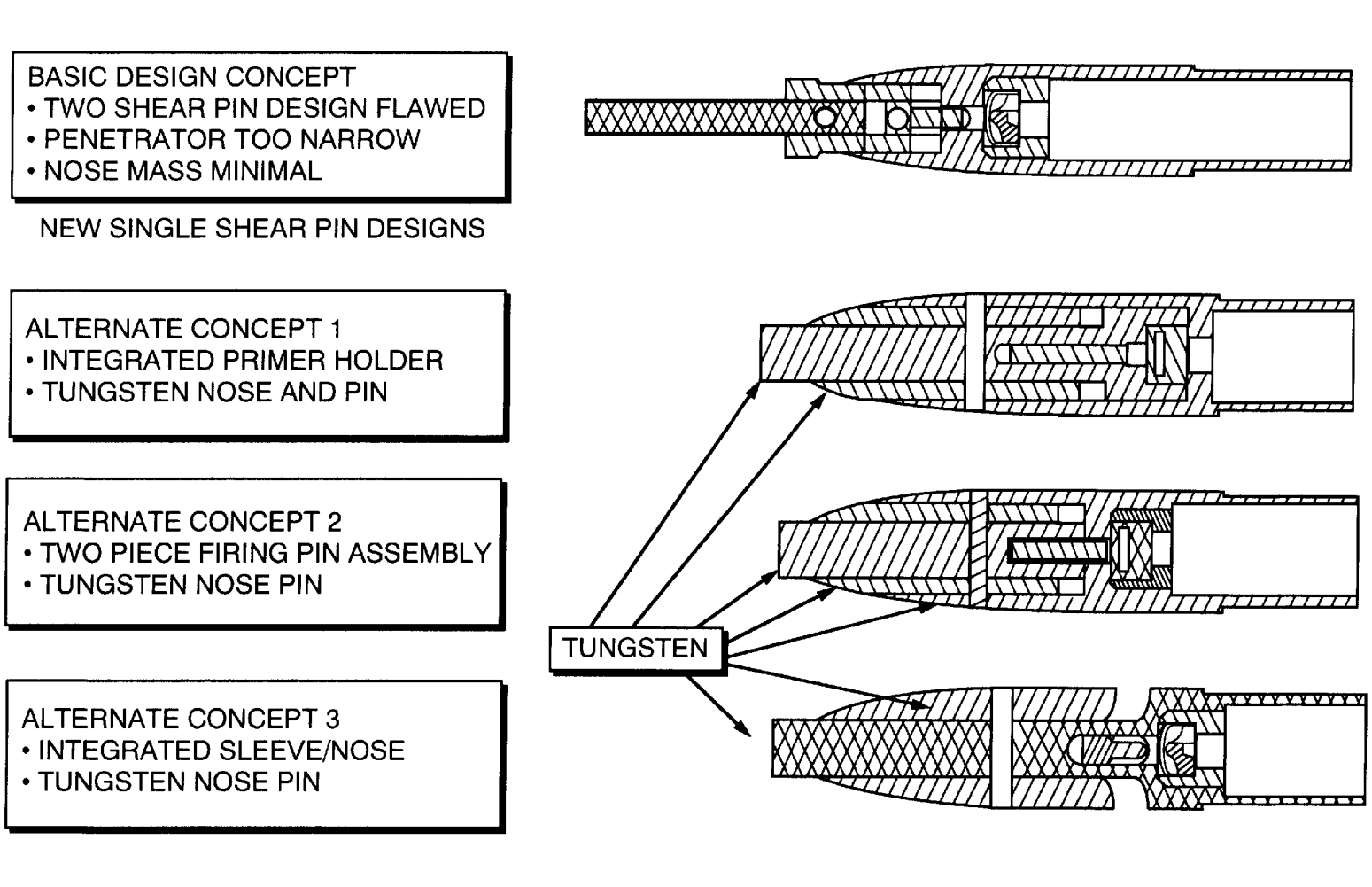
FIG. 22 illustrates the concept of incorporating an expanding head in the delayed active ignition to increase mine fill fracture and crack propagation.
Figure 23:
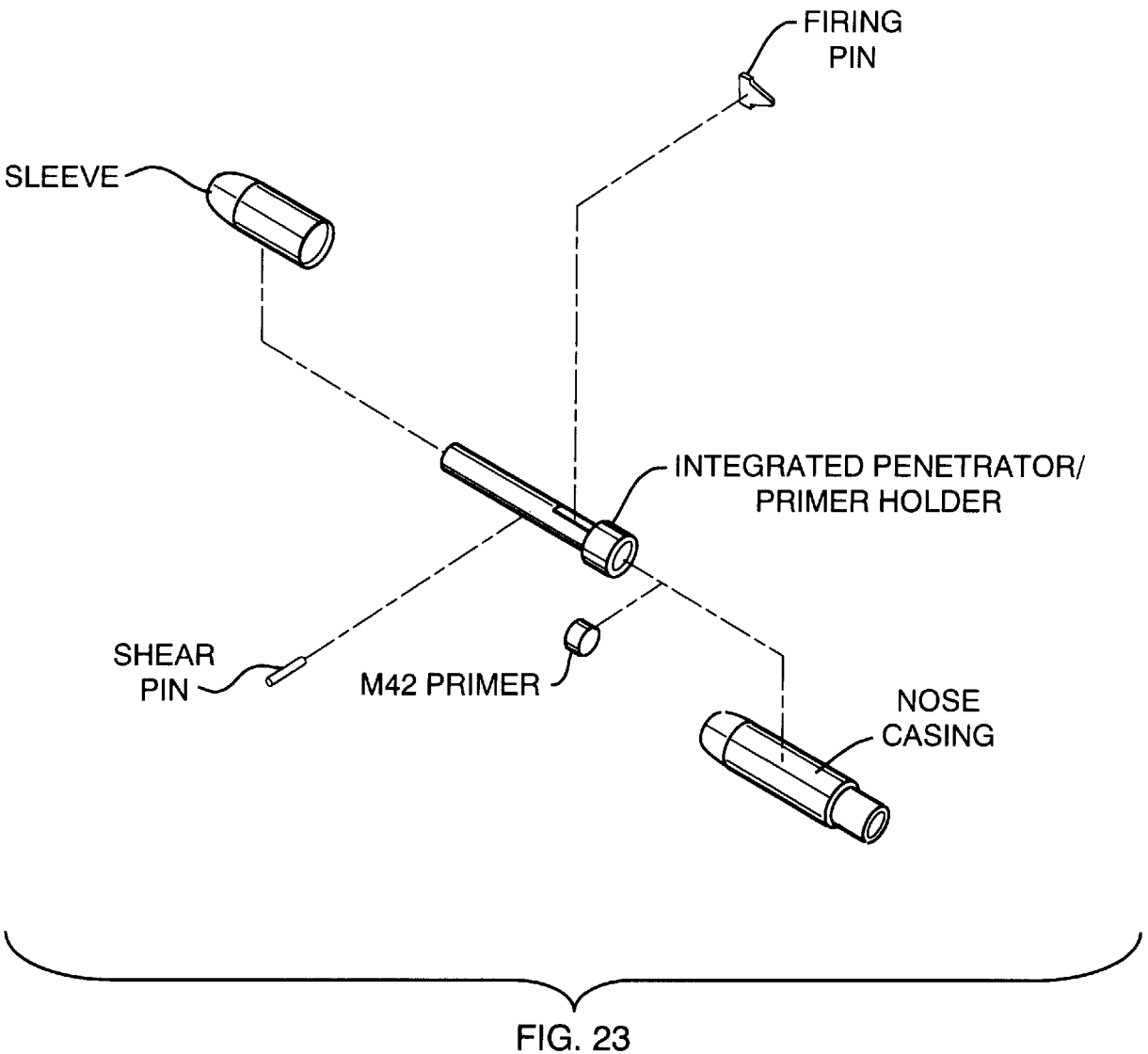
FIG. 23 illustrates alternate implementations of the delayed active ignition system located in the nose of a high temperature incendiary countermine dart.
Figure 24:
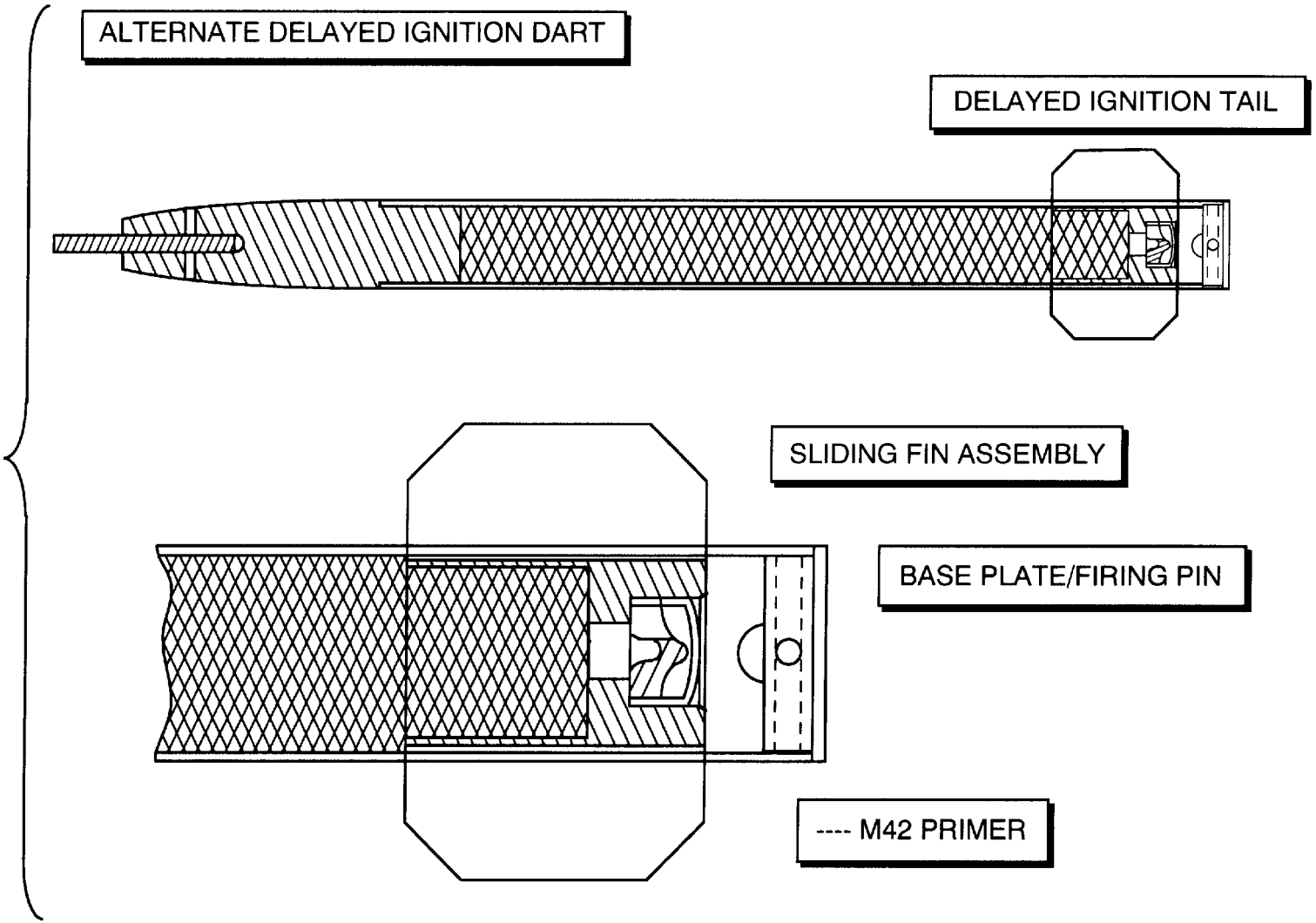
FIG. 24 illustrates a delayed active ignition system concept located in the tail of a high temperature incendiary countermine dart.

The design objectives for the delayed ignition system would be to control or delay the ignition until the dart struck the mine at which point the ignition system would activate the fill. The dart head itself should have sufficient mass to penetrate after impact with the mine to allow the expanding head capability of the dart to be realized. (FIG. 18) In the design of the circular firing pin in the delayed active ignition head, an outer lip on the circular firing pin would act to expand the walls of the dart nose to increase the caliber of the nose to cause additional mine explosive fill fracturing and cracking. The operation of a delayed ignition dart system depends on the ability to generate a terradynamic cavity or a hydrodynamic cavity in penetrating soil or water. The cavity, generated by the hardened nose pin, ensures that no soil or water comes in contact with the circular sleeve firing pin. When the countermine dart impacts the mine casing, the mine case itself then acts on the circular sleeve firing pin moving it backwards causing the primer to be ignited and, in turn, initiating the reaction of the high temperature incendiary fill (FIG. 19). The nose pin is held in place during the penetration by the large caliber shear pin. When the nose pin enters the mine casing, the cavity no longer protects the nose and the circular sleeve firing pin shear pin fails allowing the firing pin to move rearward to ignite the primer. At the same time, the outer nose element slides in and expands the sleeve and the nose to provide an increased caliber to increase the degree of break-up and fracture of the mine high explosive fill. (FIG. 20). The same effect is witnessed in penetration of water due to the hydrodynamic cavity generated by the countermine dart. The concept of employing a delayed active ignition countermine dart allows the dart to trigger its ignition system on impact with the mine while transferring 100-percent of the kinetic energy to the mine to cause mine explosive fill. break-up and fracture. At that point, the ignition sequence, causing the high temperature incendiary fill of the dart to react in a 50-microsecond time window and transfers 100-percent of the chemical energy to the mine to ensure mine deflagration or detonation. (FIG. 21). There are several alternate forms of a delayed active ignition concept that can be identified. (FIG. 22). All forms of the delayed active ignition system, however, depend on the ability to form a terradynamic cavity or a hydrodynamic cavity in penetrating soil or water to allow the delay of the ignition of the high temperature fill to be accomplished. Concepts could be defined in which the primer holder and stand-off pin are made of one piece of material with the firing pin held by a single shear pin. Concepts could be defined where the firing pin is made of two components allowing the stand-off pin to be anchored firmly to the body. Concepts also can be defined which integrate the firing pin with the nose of the countermine dart. The two-piece firing pin design using a circular portion of the firing pin in a key firing pin to interface the primer while positioning the primer on the body of the nose offers attractive design features. (FIG. 23). An alternate delayed ignition high temperature incendiary dart concept also can be defined which places the ignition system in the tail which would delay the ignition until the entire dart had penetrated into the mine case. In this case, the tail assembly is held in place by a shear pin which, when the tail impacts the mine case, is sheared allowing the tail assembly to be moved backwards impacting a standoff plate which has the firing pin on it. This stand-off plate with firing pin would activate the primer located in the sliding tail assembly and ignite the primer which, in turn, would ignite the high temperature incendiary fill in the dart. This tail delayed active ignition high temperature incendiary countermine dart would incorporate a tungsten stand-off nose pin to ensure generation of a hydrodynamic or terradynamic cavity during the penetration process. (FIG. 24).

Figure 25:
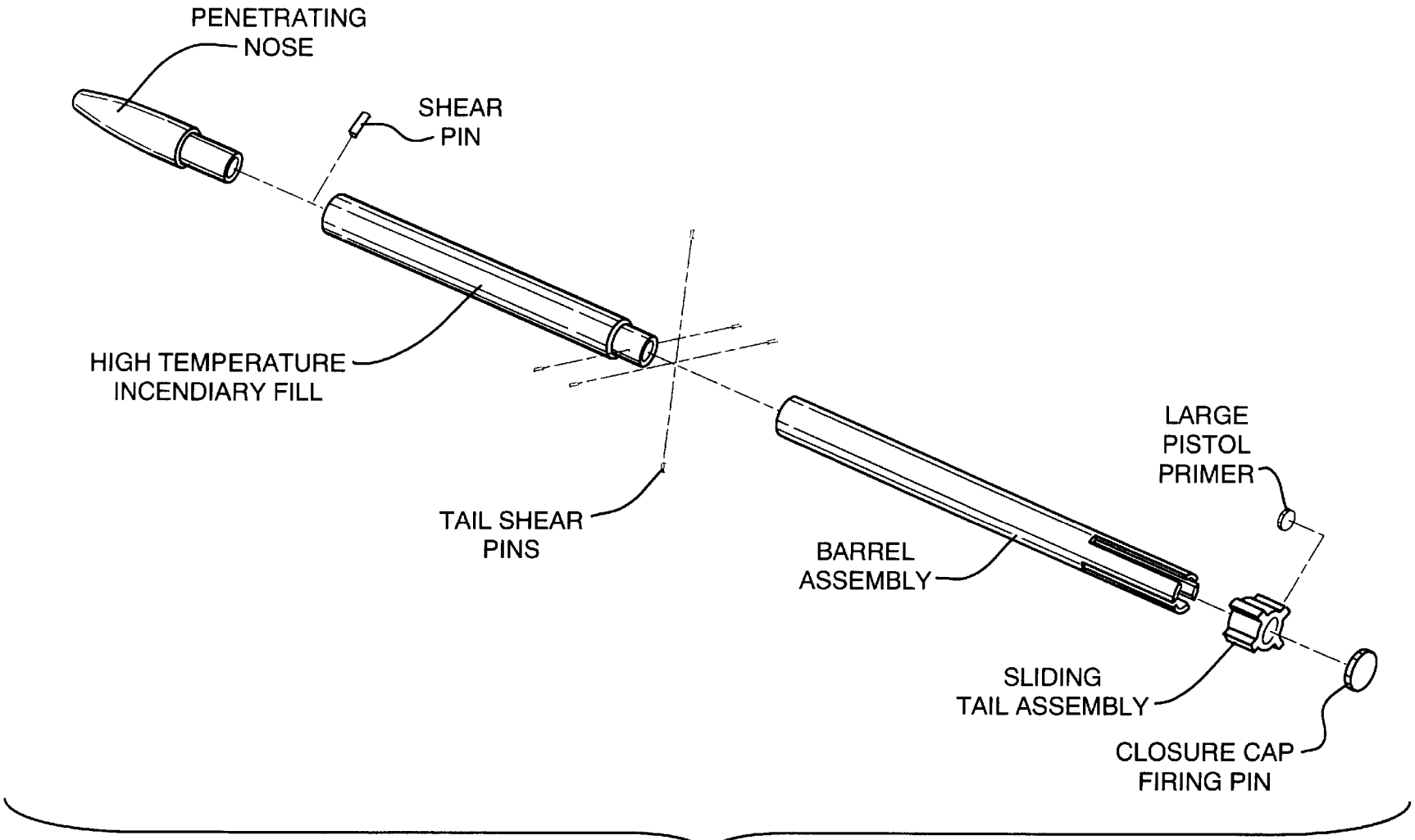
FIG. 25 illustrates the components in the assembly of a delayed active ignition system high temperature incendiary countermine dart.

The tail ignition dart assembly would incorporate a penetrating nose, high temperature incendiary fill, tail shear pins, barrel assembly, sliding tail assembly with large pistol primer, and closure cap. (FIG. 25).

It is apparent that the invention allows the clearing of minefields including surface mines and buried mines in soil or underwater mines defined individually or in mine belts in extremely short time period. The invention allows mines to be cleared by amphibious forces operating in power projection from the sea or armored task forces projecting power on land maneuvers. The concept can be delivered by air-delivered dispensers delivering countermine munitions. The concept can also be embodied in an approach where 5-inch and 155 mm gun projectiles deliver the high temperature incendiary delayed ignition countermine darts or missile artillery where the guided Multiple Launch Rocket System or Army Tactical Missile System could deliver high temperature incendiary delayed ignition darts or variants of the jet reaction controlled, GPS-guided countermine munitions.

We wish it to be understood that we do not consider the invention to be limited to the precise details shown and described in the specification or obvious modifications of these concepts will occur to those skilled in the art to which the invention pertains.

We claim:

1. An airborne countermine system comprising: at least one munitions dispenser element, a plurality of countermine munitions initially contained within said dispenser element, each of said munitions containing means for guiding said munitions to a predetermined coordinate location, and positioning the same for descent along a substantially vertical axis; means for initiating axial rotation to said countermines during vertical descent; each of said munitions containing a plurality of incendiary darts; means for opening said munitions during descent to radially distribute said darts using generated centrifugal force for individual vertical descent to a target area.

2. The system in accordance with claim 1, in which said darts comprise an elongated body containing a high temperature incendiary fill and a nose element having an axially-projecting shape capable of generating cavitation in a displaceable mass, and an axially displaceable member operable upon contacting a non-displacable mass to actuate an ignition means for detonating a high temperature fill in said dart.

3. The system in accordance with claim 1, said munitions being arranged in parallel relation within said dispenser prior to discharge.

4. The system in accordance with claim 1, in which said munitions dispenser is launched from an aircraft.

5. The system in accordance with claim 1, in which said munitions dispenser is in the form of a guided missile.

6. The method of destroying land mines and submerged mines having a hollow casing and an explosive fill within said casing, including the steps of:

a) providing at least one munitions dispenser having plural dispensable munitions, in which said munitions include guidance and control means;

b) transporting said munition dispenser to an area of operation;

c) dispensing said plural munitions while simultaneously activating said guidance and control means;

d) guiding each of said munitions to a predetermined coordinate location, and;

e) vertically propelling said munitions toward said location.

7. The method in accordance with claim 6, including the further steps of:

f) providing each munition with a plurality of high temperature incendiary darts, and;

g) radially discharging said darts from said munition for independent vertical fall to an area within said predetermined location.

8. An incendiary countermine dart comprising: an elongated body having a high temperature incendiary fill, a nose section shaped to provide cavitation upon passing through a displacable mass; firing means including an axially displaceable firing pin operative upon contact with a non-displaceable mass, and a fulminate primer activated by said firing pin communicating with said fill.

9. A dart in accordance with claim 8, said nose section having a means for radial expansion after impact with a non-displaceable mass for improved kinetic energy transfer.

10. A countermine dart in accordance with claim 9 in which said nose section comprises a stand-off pin providing cavitation, a sleeve supporting said pin, said sleeve mounting said firing pin and having an elongated forward portion which, upon contact with said non-displaceable mass, moves axially rearwardly to radially expand said nose section.

11. A dart in accordance with claim 8, further comprising tail fins, said fins being mounted for sliding movement relative to said body, said fins having fill ignition means activated by such movement.

12. A plurality of darts in accordance with claim 11, said tail fins being mounted for initial location at plural axial locations to enable positioning in relative parallel relation within a delivering munition without mutual contact of said fins.

13. A countermine dart in accordance claim 12, said stand-off pin projecting forwardly of said sleeve to enable penetration of a mine prior to contact of said mine with said sleeve, thereby terminating cavitation surrounding said sleeve.

* * * * *

UNITED STATES PATENT AND TRADEMARK OFFICE

CERTIFICATE OF CORRECTION

PATENT NO. : 6,540,175 B1
APPLICATION NO. : 09/997654
DATED : April 1, 2004
INVENTOR(S) : Joseph R. Mayersak, Lance H. Benedict and Robert M. Krass It is certified that error appears in the above-identified patent and that said Letters Patent is hereby corrected as shown below:

Column 1, line 4, insert the following:

--STATEMENT REGARDING FEDERALLY SPONSORED RESEARCH OR DEVELOPMENT

This invention was made with Government support under Contract No. N00014-01-C-0234, awarded by the United States Navy. The Government has certain rights in this invention.--

Signed and Sealed this

Fifth Day of May, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 6,540,175 B1
APPLICATION NO. : 09/997654
DATED : April 1, 2003
INVENTOR(S) : Joseph R. Mayersak, Lance H. Benedict and Robert M. Krass It is certified that error appears in the above-identified patent and that said Letters Patent is hereby corrected as shown below:

Column 1, line 4, insert the following:

--STATEMENT REGARDING FEDERALLY SPONSORED RESEARCH OR DEVELOPMENT

This invention was made with Government support under Contract No. N00014-01-C-0234, awarded by the United States Navy. The Government has certain rights in this invention.--

This certificate supersedes the Certificate of Correction issued May 5, 2009.

Signed and Sealed this

Twenty-sixth Day of May, 2009

John Doll

JOHN DOLL
*Acting Director of the United States Patent and Trademark Office*